US011840938B2

(12) United States Patent
Takata et al.

(10) Patent No.: US 11,840,938 B2
(45) Date of Patent: Dec. 12, 2023

(54) STEAM TURBINE STATOR VANE, STEAM TURBINE, AND PRODUCTION METHOD FOR STEAM TURBINE STATOR VANE

(71) Applicant: Mitsubishi Power, Ltd., Yokohama (JP)

(72) Inventors: Ryo Takata, Tokyo (JP); Yasuhiro Sasao, Yokohama (JP); Naoto Tochitani, Yokohama (JP); Soichiro Tabata, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 45 days.

(21) Appl. No.: 17/609,494

(22) PCT Filed: May 1, 2020

(86) PCT No.: PCT/JP2020/018395
§ 371 (c)(1),
(2) Date: Nov. 8, 2021

(87) PCT Pub. No.: WO2020/250596
PCT Pub. Date: Dec. 17, 2020

(65) Prior Publication Data

US 2022/0228510 A1 Jul. 21, 2022

(30) Foreign Application Priority Data

Jun. 10, 2019 (JP) ..... 2019-108080

(51) Int. Cl.
*F01D 25/32* (2006.01)
*F01D 9/02* (2006.01)

(52) U.S. Cl.
CPC ..... *F01D 25/32* (2013.01); *F01D 9/02* (2013.01); *F05D 2220/31* (2013.01); *F05D 2240/12* (2013.01); *F05D 2260/602* (2013.01)

(58) Field of Classification Search
CPC ... F01D 25/32; F01D 9/02; F01D 5/18; F01D 25/00; F01D 5/147; F05D 2220/31;
(Continued)

(56) References Cited

U.S. PATENT DOCUMENTS 6,474,942 B2 11/2002 Markytan
9,598,964 B2 3/2017 Ishibashi et al.
(Continued)

FOREIGN PATENT DOCUMENTS

JP S63-117104 A 5/1988
JP S63-280801 A 11/1988
(Continued)

OTHER PUBLICATIONS

International Search Report dated Jul. 14, 2020, counterpart Application No. PCT/JP2020/018395.
(Continued)

*Primary Examiner* — Aaron R Eastman
(74) *Attorney, Agent, or Firm* — WHDA, LLP

(57) ABSTRACT

A steam turbine stator vane includes a vane body portion which has a vane surface including a pressure surface and a suction surface, a moisture removal channel disposed in the vane body portion, at least one slit opening to the vane surface to communicate with the moisture removal channel and extending along a height direction from a base end portion toward a tip end portion of the vane body portion, and at least one groove portion disposed in the vane surface and extending from the base end portion along the height direction, at least a part of the at least one groove portion overlapping the at least one slit along the height direction.

13 Claims, 15 Drawing Sheets

(58) Field of Classification Search
CPC ..... F05D 2240/12; F05D 2260/602; F05D 2260/608; F05D 2220/32
See application file for complete search history.

(56) References Cited

U.S. PATENT DOCUMENTS

| | | | | |
|---|---|---|---|---|
| 2002/0114700 | A1* | 8/2002 | Markytan | F01D 5/147 416/236 R |
| 2007/0274824 | A1* | 11/2007 | Burdgick | F01D 5/186 415/169.1 |
| 2010/0329853 | A1* | 12/2010 | Guo | F01D 9/065 415/169.2 |
| 2011/0135447 | A1* | 6/2011 | Guo | F01D 25/32 415/169.3 |
| 2013/0177397 | A1* | 7/2013 | Burdgick | F01D 25/32 415/115 |
| 2014/0079556 | A1* | 3/2014 | Ishibashi | F01D 25/32 416/223 A |

FOREIGN PATENT DOCUMENTS

| | | | |
|---|---|---|---|
| JP | H02-064702 | U | 5/1990 |
| JP | H03-026802 | A | 2/1991 |
| JP | H04-140401 | A | 5/1992 |
| JP | 5968173 | B2 | 8/2016 |
| JP | 2019-044723 | A | 3/2019 |

OTHER PUBLICATIONS

Notification of Transmittal of Translation of the International Preliminary Report on Patentability (Form PCT/IB/338) issued in counterpart International Application No. PCT/JP2020/018395 dated Dec. 23, 2021, with Forms PCT/IB/373 and PCT/ISA/237. (14 pages).

* cited by examiner

STEAM TURBINE STATOR VANE, STEAM TURBINE, AND PRODUCTION METHOD FOR STEAM TURBINE STATOR VANE

TECHNICAL FIELD

The present disclosure relates to a steam turbine stator vane, a steam turbine including the steam turbine stator vane, and a production method for the steam turbine stator vane.

BACKGROUND

In the vicinity of a last stage of a steam turbine, the wetness of a steam flow is not less than 8%. Water droplets generated from the wet steam flow cause a moisture loss, decreasing turbine efficiency. Further, the water droplets generated from the wet steam flow adhere to the surface of the stator vane, forming a water film. The above-described water film becomes a water film flow on the surface of the stator vane, flows to a trailing edge side of the stator vane, and is scattered at the trailing edge of the stator vane, forming coarse water droplets. Collision of the above-described coarse water droplets against a rotor blade rotating at high speed is one of major causes of triggering erosion of the rotor blade.

In order to prevent the erosion and the moisture loss of the steam turbine, removing a liquid (water droplets) adhering to the surface of the stator vane is effective. Conventionally, in order to remove a liquid adhering to the surface of a stator vane, a groove and a slit are formed in the surface of the stator vane (see Patent Documents 1, 2). The liquid adhering to the surface of the stator vane is sent in the groove and the slit, and is discharged from the groove and the slit to the outside of a system. Patent Document 1 discloses forming one or a plurality of grooves in the surface of the stator vane. The groove described in Patent Document 1 extends toward the radial direction of a steam turbine over one end portion to another end portion of the stator vane in the longitudinal direction. Patent Document 2 discloses forming, in the surface of a hollow stator vane internally including a cavity, one or a plurality of slits communicating with the cavity.

CITATION LIST

Patent Literature

Patent Document 1: U.S. Pat. No. 6,474,942B
Patent Document 2: JPH3-26802A

SUMMARY

Technical Problem

In order to improve removal efficiency of the liquid adhering to the surface of the stator vane, it is considered that two of the grooves described in Patent Document 1 are disposed in parallel in the surface of the stator vane along the height direction. However, due to low removal efficiency of the above-described grooves themselves, a removal amount of the liquid is small even if the above-described two grooves are disposed in parallel, which may be unable to improve removal efficiency of the liquid.

Further, in order to improve removal efficiency of the above-described liquid, it is considered that two of the slits described in Patent Document 2 are disposed in parallel in the surface of the stator vane along the height direction. In this case, due to a pressure difference between the first slit disposed upstream in the above-described axial direction and the second slit disposed downstream in the above-described axial direction, the liquid sucked from the first slit to the cavity may spout (flow back) from the second slit having a lower pressure than the first slit. Thus, it is impossible to increase the removal amount of the liquid, which may be unable to improve removal efficiency of the liquid. In order to prevent the backflow of the liquid, if the width of the slit is increased to improve a suction pressure of the slit, the amount of drive steam leaking to the cavity through the slit increases, which may decrease performance of the steam turbine.

In view of the above issues, an object of at least one embodiment of the present invention is to provide a steam turbine stator vane capable of preventing the decrease in performance of the steam turbine as well as improving removal efficiency of the liquid adhering to the surface of the stator vane, and a steam turbine including the steam turbine stator vane.

Solution to Problem (1) A steam turbine stator vane according to at least one embodiment of the present invention includes a vane body portion which has a vane surface including a pressure surface and a suction surface, a moisture removal channel disposed in the above-described vane body portion, at least one slit opening to the above-described vane surface to communicate with the above-described moisture removal channel, and extending along a height direction from a base end portion toward a tip end portion of the above-described vane body portion, and at least one groove portion disposed in the above-described vane surface and extending from the above-described base end portion along the above-described height direction, at least a part of the at least one groove portion overlapping the above-described at least one slit along the above-described height direction.

With the above configuration (1), the steam turbine stator vane includes the slit and the groove portion disposed in the vane surface which is the surface of the stator vane, and the slit and the groove portion overlap at least partially along the height direction. Thus, it is possible to remove a liquid collected in the vane surface by a section (upstream drainage section) of the slit and the groove portion disposed upstream of the vane surface. Further, it is possible to remove a liquid collected downstream of the upstream drainage section in the vane surface, by a section (downstream drainage section) of the slit and the groove portion disposed downstream of the vane surface. That is, the above-described steam turbine stator vane can remove the liquid adhering to the vane surface, by the groove portion and the slit having higher removal efficiency of the liquid than the groove portion. Thus, it is possible to improve the removal efficiency of the liquid adhering to the vane surface.

Further, since one of the upstream drainage section or the downstream drainage section is the groove portion that does not communicate with the moisture removal channel, the above-described steam turbine stator vane can reduce the amount of drive steam leaking to the moisture removal channel through the slit, as compared with a configuration, where two slits overlapping each other along the height direction are disposed in the vane surface, as in a steam turbine stator vane according to a comparative example. Further, unlike the configuration, where the two slits overlapping each other along the height direction are disposed in the vane surface, as in the steam turbine stator vane according to the comparative example, the above-described steam turbine stator vane is free from the risk that the liquid flows back from the moisture removal channel via the slit, and thus a slit width need not be increased to improve a suction pressure of the slit. By suppressing the suction pressure of the slit, it is possible to further reduce the amount of the drive steam leaking to the moisture removal channel through the slit. Thus, the above-described steam turbine stator vane can reduce the amount of the drive steam leaking to the moisture removal channel through the slit, making it possible to prevent a decrease in performance of the steam turbine.

(2) In some embodiments, in the steam turbine stator vane according to the above configuration (1), the above-described at least one groove portion is configured to be inclined to a side of a trailing edge from the above-described tip end portion toward the above-described base end portion.

With the above configuration (2), since the at least one groove portion is configured to be inclined to the side of the trailing edge from the tip end portion toward the base end portion, the liquid stored in the groove portion is pushed by the flow of the steam flowing through in the steam turbine and flows toward the base end portion which is a discharge side of the liquid. Thus, the above-described groove portion can improve removal efficiency of the liquid stored in the groove portion.

(3) In some embodiments, in the steam turbine stator vane according to the above configuration (1) or (2), the above-described at least one slit includes a plurality of slits disposed separately from each other in the above-described height direction.

With the above configuration (3), since the plurality of slits are disposed separately from each other in the height direction, as compared with a case where the single slit extends along the height direction, it is possible to improve strength of the steam turbine stator vane in the vicinity of the slit. Improving the strength of the steam turbine stator vane in the vicinity of the slit, it is possible to reduce the thickness of the steam turbine stator vane, and thus to reduce a production cost of the steam turbine stator vane.

(4) In some embodiments, the steam turbine stator vane according to the above configuration (3) further includes a recess which is disposed in the above-described vane surface and to which the above-described plurality of slits open.

With the above configuration (4), since the plurality of slits disposed separately from each other open to the recess disposed in the vane surface, the liquid adhering to the vane surface is stored in the recess. Thus, the steam turbine stator vane including the above-described recess can prevent the liquid adhering to the vane surface from flowing downstream of the slits in the vane surface through the slits. Thus, the steam turbine stator vane including the above-described recess can improve removal efficiency of the liquid adhering to the vane surface.

(5) In some embodiments, in the steam turbine stator vane according to anyone of the above configurations (1) to (4), the above-described at least one slit is disposed between the above-described at least one groove portion and a leading edge.

With the above configuration (5), it is possible to remove the liquid that cannot be removed from the vane surface by the slit or the liquid adhering between the slit and the trailing edge on the vane surface, by the groove portion disposed between the slit and the trailing edge on the vane surface.

(6) In some embodiments, in the steam turbine stator vane according to anyone of the above configurations (1) to (4), the above-described at least one slit is disposed between the above-described at least one groove portion and a trailing edge.

With the above configuration (6), it is possible to remove the liquid that cannot be removed from the vane surface by the groove portion or the liquid adhering between the groove portion and the trailing edge on the vane surface, by the slit disposed between the groove portion and the trailing edge on the vane surface. The groove portion can reduce the amount of the liquid reaching the slit, and the slit has higher removal efficiency of the liquid adhering to the vane surface than the groove portion, making it possible to remove the liquid reaching the slit. Thus, with the above configuration, by disposing the slit between the groove portion and the trailing edge, it is possible to effectively remove the liquid adhering to the vane surface.

(7) In some embodiments, in the steam turbine stator vane according to any one of the above configurations (1) to (6), the above-described vane body portion includes a curved plate encompassing the above-described moisture removal channel and configured such that a difference between a maximum value and a minimum value of a thickness of the above-described curved plate falls within 40% of an average value of the above-described thickness.

With the above configuration (7), by equalizing the thickness of the curved plate, it is possible to reduce a material cost of the curved plate by cutting wasteful consumption of a material forming the curved plate, and thus to reduce the production cost of the stator vane.

(8) In some embodiments, in the steam turbine stator vane according to the above configuration (7), the above-described curved plate includes a pressure surface-side curved plate which has a surface including at least a part of the above-described pressure surface, and a suction surface-side curved plate which has a surface including at least a part of the above-described suction surface, and one of the above-described at least one slit or the above-described at least one groove portion is configured to include a joint where one end portion of the above-described pressure surface-side curved plate and one end portion of the above-described suction surface-side curved plate are joined by welding.

With the above configuration (8), one of the slit or the groove portion includes the joint where the one end portion of the pressure surface-side curved plate and the one end portion of the suction surface-side curved plate are joined by welding. That is, the shape of one of the slit or the groove portion is formed, when the curved plate is formed by welding the one end portion of the pressure surface-side curved plate and the one end portion of the suction surface-side curved plate. With the above configuration, since additional processing such as cutting is not needed to form one of the slit or the groove portion, it is possible to reduce a processing cost, and thus to reduce the production cost of the stator vane. Further, with the above configuration, since one of the slit or the groove portion can be formed without processing such as cutting, it is possible to prevent a decrease in strength in the vicinity of one of the slit or the groove portion.

(9) In some embodiments, in the steam turbine stator vane according to the above configuration (8), the above-described vane body portion further includes a trailing edge portion disposed between the above-described joint and a trailing edge, the trailing edge portion having a trailing edge-side pressure surface connected to the above-described trailing edge and a trailing edge-side wall surface extending from a front end portion on the above-described trailing edge-side pressure surface along a direction intersecting with the above-described trailing edge-side pressure surface, and the above-described at least one groove portion includes the above-described joint, and a part of the above-described at least one groove portion is defined by the above-described trailing edge-side wall surface.

With the above configuration (9), the at least one groove portion includes the joint, and a part of the at least one groove portion is defined by the trailing edge-side wall surface. That is, the shape of the groove portion is formed as a part of the trailing edge-side wall surface of the trailing edge portion, when the curved plate is formed by welding. Since a part of the above-described groove portion is defined by the trailing edge-side wall surface extending along the direction intersecting with the trailing edge-side pressure surface, it is possible to effectively prevent the liquid adhering to the vane surface from flowing toward the trailing edge-side pressure surface from the trailing edge-side wall surface.

(10) In some embodiments, in the steam turbine stator vane according to the above configuration (8), the above-described vane body portion further includes a trailing edge portion disposed between the above-described joint and a trailing edge, the trailing edge portion having a trailing edge-side pressure surface connected to the above-described trailing edge and a trailing edge-side wall surface extending from a front end portion on the above-described trailing edge-side pressure surface along a direction intersecting with the above-described trailing edge-side pressure surface, and the above-described at least one slit includes the above-described joint, and a part of the above-described at least one slit is defined by the above-described trailing edge-side wall surface.

With the above configuration (10), the at least one slit includes the joint, and apart of the slit is defined by the trailing edge-side wall surface. That is, the shape of the slit is formed as a part of the trailing edge-side wall surface of the trailing edge portion, when the curved plate is formed by welding. Since a part of the above-described slit is defined by the trailing edge-side wall surface extending along the direction intersecting with the trailing edge-side pressure surface, the liquid adhering to the vane surface is removed from the vane surface by the slit in the trailing edge-side wall surface. Thus, with the above configuration, it is possible to effectively prevent the liquid adhering to the vane surface from flowing toward the trailing edge-side pressure surface from the trailing edge-side wall surface.

(11) In some embodiments, in the steam turbine stator vane according to the above configuration (8), the above-described suction surface-side curved plate includes an extension portion extending from a trailing edge toward a leading edge, the extension portion having a surface including at least a part of the above-described pressure surface, the above-described one end portion of the above-described suction surface-side curved plate includes a front end portion of the above-described extension portion located on a side of the leading edge, and the above-described at least one groove portion includes the above-described joint, and a part of the above-described at least one groove portion is defined by an end surface at the above-described front end portion of the above-described extension portion.

With the above configuration (11), the at least one groove portion includes the joint, and a part of the at least one groove portion is defined by the end surface at the front end portion of the extension portion. That is, the shape of the groove portion is formed as a part of the end surface at the front end portion of the extension portion, when the curved plate is formed by welding the one end portion of the pressure surface-side curved plate and the above-described front end portion. Since a part of the above-described groove portion is defined by the end surface at the front end portion of the extension portion located on the side of the leading edge, it is possible to effectively prevent the liquid adhering to the end surface from flowing toward the pressure surface of the extension portion.

(12) A steam turbine according to at least one embodiment of the present invention includes the steam turbine stator vane according to any one of the above configurations (1) to (11), an annular member for supporting the above-described steam turbine stator vane, and a cavity disposed in the above-described annular member and configured to receive a liquid from each of the above-described moisture removal channel and the above-described at least one groove portion in the above-described vane body portion.

With the above configuration (12), since the steam turbine includes the cavity disposed in the annular member and configured to receive the liquid from each of the moisture removal channel and the at least one groove portion in the vane body portion, it is possible to store, in the cavity, the liquid removed from the vane surface by the slit and the groove portion. Storing, in the cavity, the liquid removed from the vane surface by the slit and the groove portion, it is possible to prevent that the liquid accumulates in the slit and the moisture removal channel in the vane body portion, and removal efficiency of the liquid adhering to the vane surface by the slit and the groove portion is decreased. Thus, the above-described steam turbine can effectively remove the liquid adhering to the vane surface by the slit and the groove portion.

(13) A production method for a steam turbine stator vane according to at least one embodiment of the present invention includes a slit forming step of forming at least one slit that opens to a vane surface of a vane body portion, which has the above-described vane surface including a pressure surface and a suction surface, to communicate with a moisture removal channel disposed in the above-described vane body portion, and extends along a height direction from a base end portion toward a tip end portion of the above-described vane body portion, and a groove portion forming step of forming at least one groove portion extending from the above-described base end portion in the above-described vane surface along the above-described height direction, at least a part of the at least one groove portion overlapping the above-described at least one slit along the above-described height direction.

With the above method (13), the production method for the steam turbine stator vane includes the slit forming step of forming the at least one slit, and the groove portion forming step of forming the at least one groove portion. The steam turbine stator vane produced by the production method for the steam turbine stator vane includes the slit and the groove portion disposed in the vane surface which is the surface of the stator vane, and the slit and the groove portion overlap at least partially along the height direction. Thus, the steam turbine stator vane produced by the production method for the steam turbine stator vane can improve removal efficiency of the liquid adhering to the vane surface and can prevent the decrease in performance of the steam turbine.

Advantageous Effects

According to at least one embodiment of the present invention, provided are a steam turbine stator vane capable of preventing a decrease in performance of a steam turbine as well as improving removal efficiency of a liquid adhering to the surface of a stator vane, and a steam turbine including the steam turbine stator vane.

DETAILED DESCRIPTION

Figure 1:
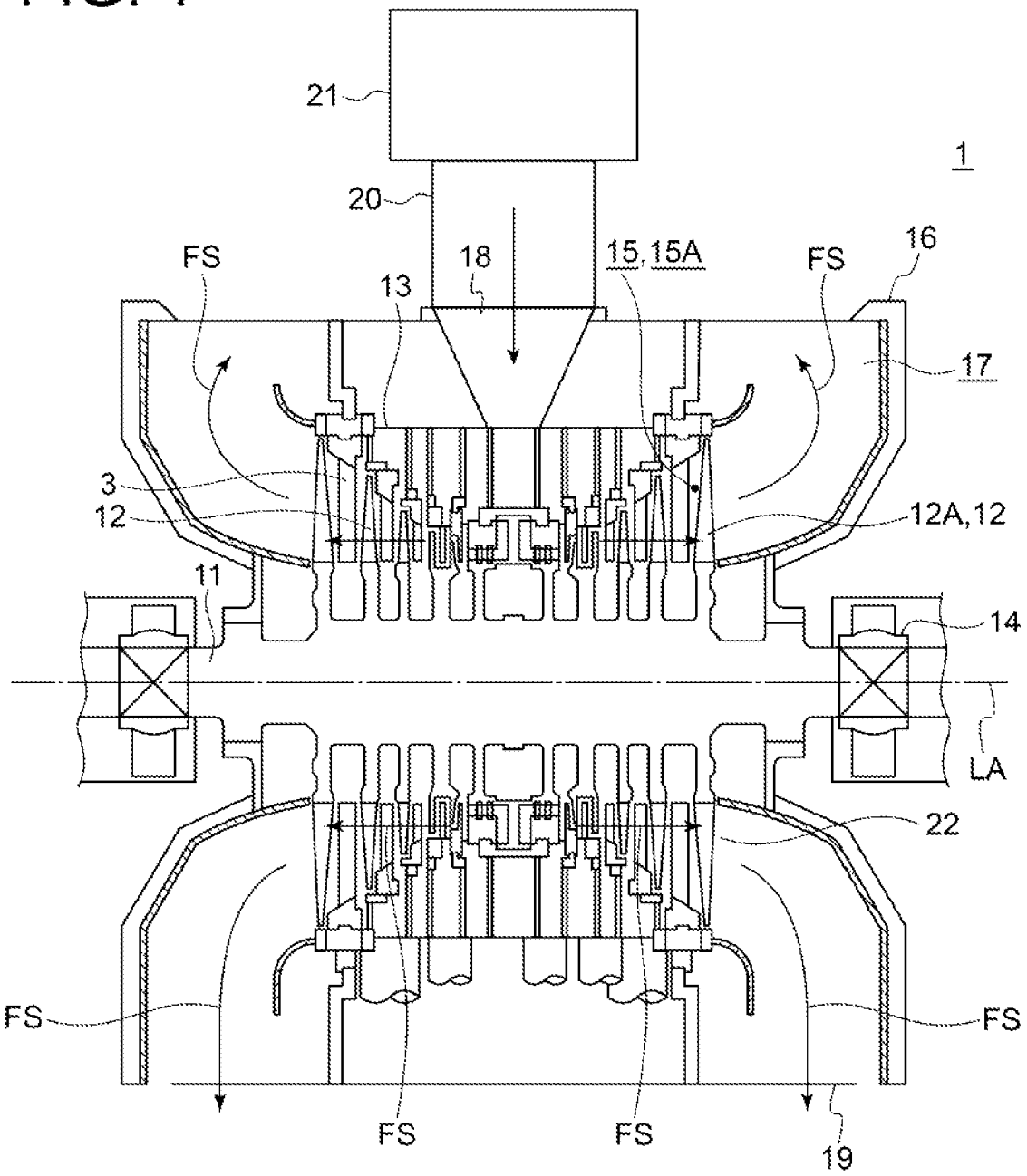
FIG. 1 is a schematic cross-sectional view of a steam turbine including a steam turbine stator vane according to an embodiment of the present invention, taken along the axial direction.

Some embodiments of the present invention will be described below with reference to the accompanying drawings. It is intended, however, that unless particularly identified, dimensions, materials, shapes, relative positions and the like of components described or shown in the drawings as the embodiments shall be interpreted as illustrative only and not intended to limit the scope of the present invention.

For instance, an expression of relative or absolute arrangement such as"in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal", and "uniform" shall not be construed as indicating only the state in which the feature is strictly equal, but also includes a state in which there is a tolerance or a difference that can still achieve the same function.

Further, for instance, an expression of a shape such as a rectangular shape or a tubular shape shall not be construed as only the geometrically strict shape, but also includes a shape with unevenness or chamfered corners within the range in which the same effect can be achieved.

On the other hand, the expressions "comprising", "including" or "having" one constitutional element is not an exclusive expression that excludes the presence of other constitutional elements.

The same configurations are indicated by the same reference characters and may not be described again in detail.

FIG. 1 is a schematic cross-sectional view of a steam turbine including a steam turbine stator vane according to an embodiment of the present invention, taken along the axial direction. Each arrow FS shown in FIG. 1, and FIGS. 2 to 5 and 7 to 14 to be described later schematically illustrates a steam flow direction. Hereinafter, the steam turbine stator vane may simply be referred to as a stator vane, and a steam turbine rotor blade may simply be referred to as a rotor blade.

As shown in FIG. 1, a steam turbine 1 includes a rotor 11 configured to be rotatable about an axis LA, at least one rotor blade 12 mechanically coupled to the rotor 11, an annular member 13 for rotatably housing the rotor 11 and the rotor blade 12, and at least one stator vane 3 disposed opposite to the rotor blade 12 across a gap as well as mechanically coupled to the annular member 13. The rotor 11 is rotatably supported by a bearing 14.

The annular member 13 defines an inner space 15 with the rotor 11. The annular member 13 and the stator vane 3 remain still without being linked to rotations of the rotor 11 and the rotor blade 12. The stator vane 3 extends along the radial direction (a direction orthogonal to the axis LA of the steam turbine 1) so as to traverse the inner space 15 from the annular member 13 toward the rotor 11. The rotor blade 12 extends along the radial direction so as to traverse the inner space 15 from the rotor 11 toward the annular member 13.

As shown in FIG. 1, the steam turbine 1 further includes a casing 16 for supporting the annular member 13 as well as housing the annular member 13. The casing 16 internally defines an exhaust hood 17. Further, in the casing 16, a steam inlet 18 for introducing steam to the inner space 15, and a steam outlet 19 for discharging steam to the outside of the steam turbine 1 are formed.

In the illustrated embodiment, as shown in FIG. 1, the steam inlet 18 is configured to allow inflow of steam, which is discharged from a steam generation device 21 for generating steam, via a steam introduction line 20. As the steam generation device 21, a boiler can be given as an example. As the steam introduction line 20, a steam supply pipe for connecting the steam inlet 18 and the steam generation device 21 can be given as an example. The steam discharged from the steam generation device 21 and passing through the steam inlet 18 flows into the inner space 15.

The steam introduced to the inner space 15 mainly flows along the axial direction (a direction in which the axis LA of the steam turbine 1 extends). Hereinafter, upstream of the steam flow direction may simply be referred to as "upstream", and downstream of the steam flow direction may simply be referred to as "downstream".

With the steam flowing through the inner space 15 along the axial direction being a working fluid, the steam turbine 1 is configured to convert energy of the working fluid into rotational energy of the rotor 11. In the illustrated embodiment, provided that the combination of a vane row of the stator vanes 3 and a blade row of the rotor blades 12 is one stage, the steam turbine 1 includes a plurality of stages. The stator vanes 3 of each stage are disposed at predetermined intervals along the circumferential direction. The rotor blades 12 of each stage are disposed at predetermined intervals along the circumferential direction of the rotor 11. The stator vanes 3 of each stage rectify steam when the steam passes between the stator vanes 3 of each stage, and upon reception of the steam rectified by the stator vanes 3, the rotor blades 12 of each stage convert a force received from the steam into a rotational force to rotate the rotor 11. By the rotation of the rotor 11, a generator (not shown) mechanically connected to the rotor 11 is driven.

As shown in FIG. 1, the exhaust hood 17 is disposed downstream of the inner space 15. The steam having passed through the stator vanes 3 and the rotor blades 12 in the inner space 15 flows into the exhaust hood 17 from an exhaust hood inlet 22 located downstream of a last-stage rotor blade 12A which is a rotor blade located most downstream in the steam flow direction. The inflow steam passes through the exhaust hood 17, and is then discharged from the above-described steam outlet 19 to the outside of the steam turbine 1.

Figure 2:
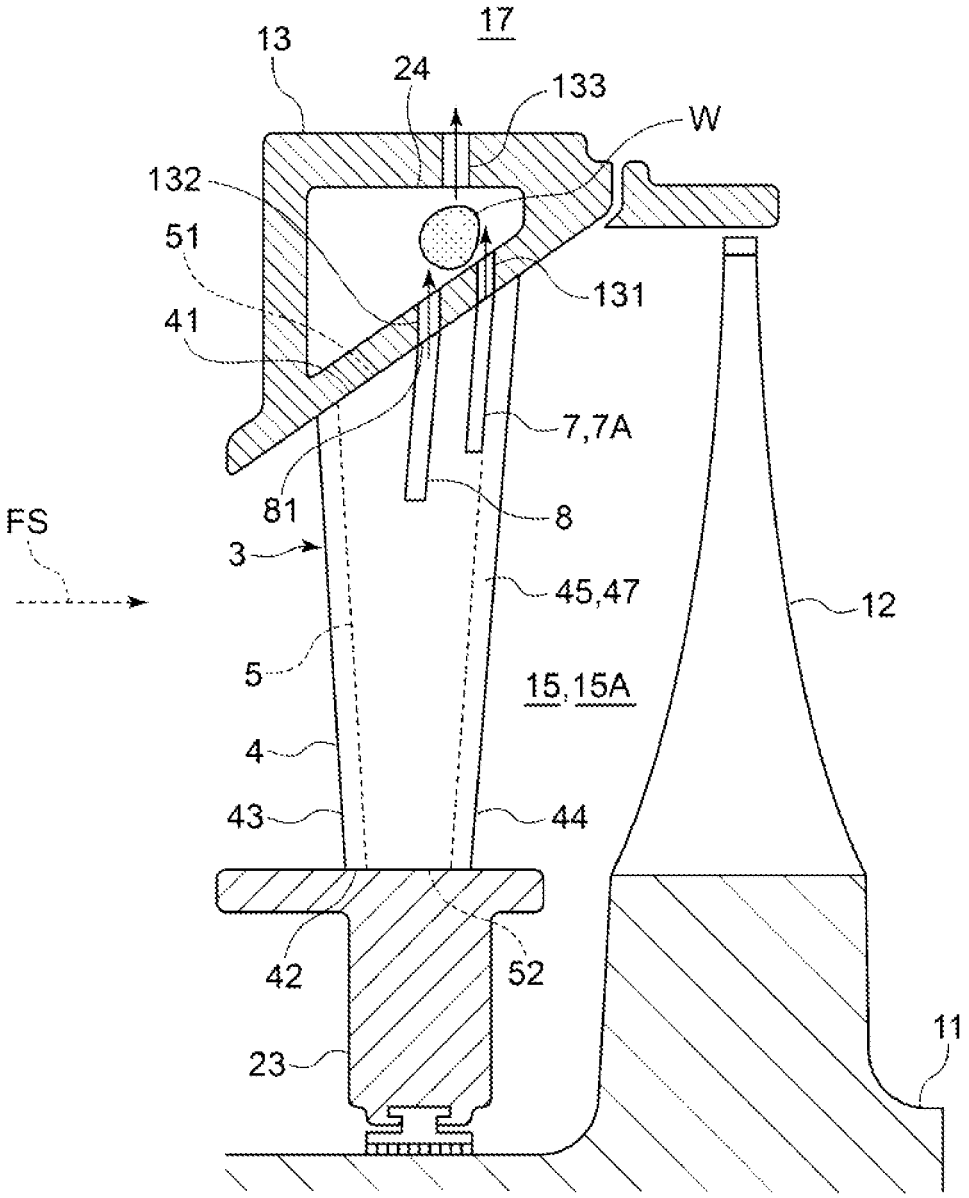
FIG. 2 is a schematic partially enlarged cross-sectional view of the steam turbine including the steam turbine stator vane according to an embodiment of the present invention, taken along the axial direction.
Figure 3:
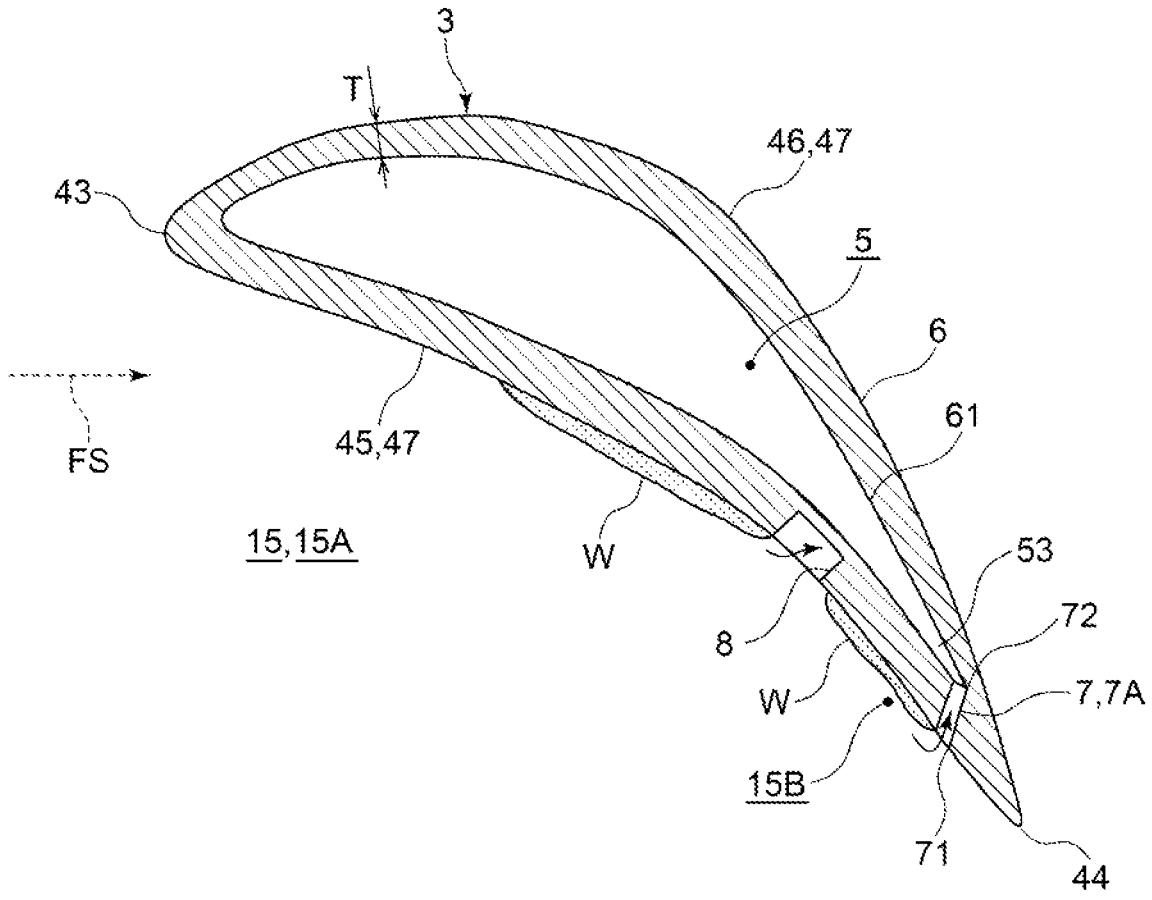
FIG. 3 is a schematic cross-sectional view of the steam turbine stator vane according to an embodiment of the present invention, taken along a direction orthogonal to the height direction.

FIG. 2 is a schematic partially enlarged cross-sectional view of the steam turbine including the steam turbine stator vane according to an embodiment of the present invention, taken along the axial direction. FIG. 3 is a schematic cross-sectional view of the steam turbine stator vane according to an embodiment of the present invention, taken along a direction orthogonal to the height direction.

As shown in FIG. 2, the stator vane 3 includes a vane body portion 4 extending along the height direction (the vertical direction in FIG. 2). In the illustrated embodiment, the vane body portion 4 includes a base end portion 41 disposed at one end in the height direction, and a tip end portion 42 disposed at another end in the height direction. The base end portion 41 is connected to the above-described annular member 13, and the tip end portion 42 is connected to an annular diaphragm 23 having a smaller diameter than the annular member 13.

As shown in FIG. 3, the vane body portion 4 has a vane surface 47 that includes a pressure surface 45 which is one surface extending between a leading edge 43 and a trailing edge 44, and a suction surface 46 which is another surface extending between the leading edge 43 and the trailing edge 44. The pressure surface 45 includes a surface curved into a concave shape, and the suction surface 46 includes a surface curved into a convex shape.

The stator vane 3 is disposed in a region 15A of the inner space 15 where a wet steam flow flows. In a certain embodiment, the region 15A is a region that satisfies a condition where the wetness of the steam flow is not less than 5% during the operation of the steam turbine 1. The vane body portion 4 is disposed such that the leading edge 43 is located upstream and the trailing edge 44 is located downstream in the steam flow direction. The pressure surface 45 is disposed to intersect with the steam flow direction so as to receive steam. Moisture in the wet steam flow adheres to the vane surface 47 (the pressure surface 45 and the suction surface 46) as water droplets (liquid).

As shown in FIG. 3, the vane body portion 4 internally forms a moisture removal channel 5. In the illustrated embodiment, the vane body portion 4 includes a curved plate 6 encompassing the moisture removal channel 5. The moisture removal channel 5 is defined by an inner surface 61 which is located opposite to the vane surface 47 of the curved plate 6 having the vane surface 47. In some other embodiments, the moisture removal channel 5 may be formed in the hollow vane body portion 4.

As shown in FIG. 2, the moisture removal channel 5 extends toward the tip end portion 42 from a base end-side opening portion 51 opening to the base end portion 41 along the height direction. In the illustrated embodiment, the moisture removal channel 5 extends from the base end-side opening portion 51 to a tip end-side opening portion 52 opening to the tip end portion 42.

As shown in FIG. 3, the stator vane 3 includes at least one slit 7 opening to the vane surface 47 and communicating with the moisture removal channel 5, and at least one groove portion 8 disposed in the vane surface 47. The at least one groove portion 8 is configured not to communicate with the moisture removal channel 5. As shown in FIG. 2, the at least one slit 7 extends along a height direction from the base end portion 41 toward the tip end portion 42 of the vane body portion 4. Further, the at least one groove portion 8 extends from the base end portion 41 of the vane body portion 4 along the height direction, at least a part of the groove portion 8 overlapping the at least one slit along the height direction.

As shown in FIG. 2, inside the annular member 13, a cavity 24 capable of storing a liquid is disposed. The cavity 24 is configured to receive a liquid W from each of the moisture removal channel 5 and the at least one groove portion 8 in the vane body portion 4. In the illustrated embodiment, the annular member 13 internally forms a first communication hole 131 for causing the moisture removal channel 5 and the cavity 24 to communicate with each other, a second communication hole 132 for causing the groove portion 8 and the cavity 24 to communicate with each other, and a third communication hole 133 for causing the cavity 24 and the exhaust hood 17 to communicate with each other. During the operation of the steam turbine 1, the exhaust hood 17 is lower in pressure than the cavity 24, and the cavity 24 is lower in pressure than the moisture removal channel 5. Then, the moisture removal channel 5 is lower in pressure than a section 15B of the region 15A facing the vane surface 47.

The liquid W adhering between the leading edge 43 and the slit 7 in the vane surface 47 is sucked to the moisture removal channel 5 via the slit 7 by a differential pressure between the moisture removal channel 5 and the section 15B of the region 15A facing the vane surface 47. The liquid W sucked to the moisture removal channel 5 is sucked to the cavity 24 via the first communication hole 131 by a differential pressure between the moisture removal channel 5 and the cavity 24.

The liquid W adhering between the leading edge 43 and the groove portion 8 in the vane surface 47 is pushed by the flow of the steam flowing through the region 15A and enters the groove portion 8. The liquid W entering the groove portion 8 is sucked to the cavity 24 via the second communication hole 132 by a differential pressure between the groove portion 8 and the cavity 24.

The liquid W stored in the cavity 24 is discharged to the exhaust hood 17 via the third communication hole 133 by a differential pressure between the cavity 24 and the exhaust hood 17. In some other embodiments, the liquid W may be discharged to the outside of the steam turbine 1, or it may be configured such that the liquid W is sucked by a suction device (not shown) such as a suction pump.

In the embodiment shown in FIG. 2, each of the slit 7 and the groove portion 8 is disposed between the center and the base end portion 41 in the height direction. In some other embodiments, each of the slit 7 and the groove portion 8 may extend between the center and the tip end portion 42 in the height direction, or may extend over the entire length in the height direction.

In the embodiment shown in FIG. 3, each of the slit 7 and the groove portion 8 is disposed between the trailing edge 44 and the center of the pressure surface 45. The slit 7 includes an inlet opening 71 opening to the pressure surface 45, and an outlet opening 72 opening to the inner surface 61 of the curved plate 6 and communicating with a trailing edge-side end portion 53 of the moisture removal channel 5. The groove portion 8 is disposed between the slit 7 and the leading edge 43.

In some other embodiments, each of the slit 7 and the groove portion 8 may be disposed between the leading edge 43 and the center of the pressure surface 45 or in the suction surface 46. However, since liquid (water film flow) is collected on the side of the trailing edge 44 in the pressure surface 45, each of the slit 7 and the groove portion 8 is preferably disposed in the pressure surface 45 relative to the suction surface 46 and is preferably disposed near the trailing edge 44 in the pressure surface 45. Further, the groove portion 8 may be disposed between the slit 7 and the trailing edge 44.

Figure 4:
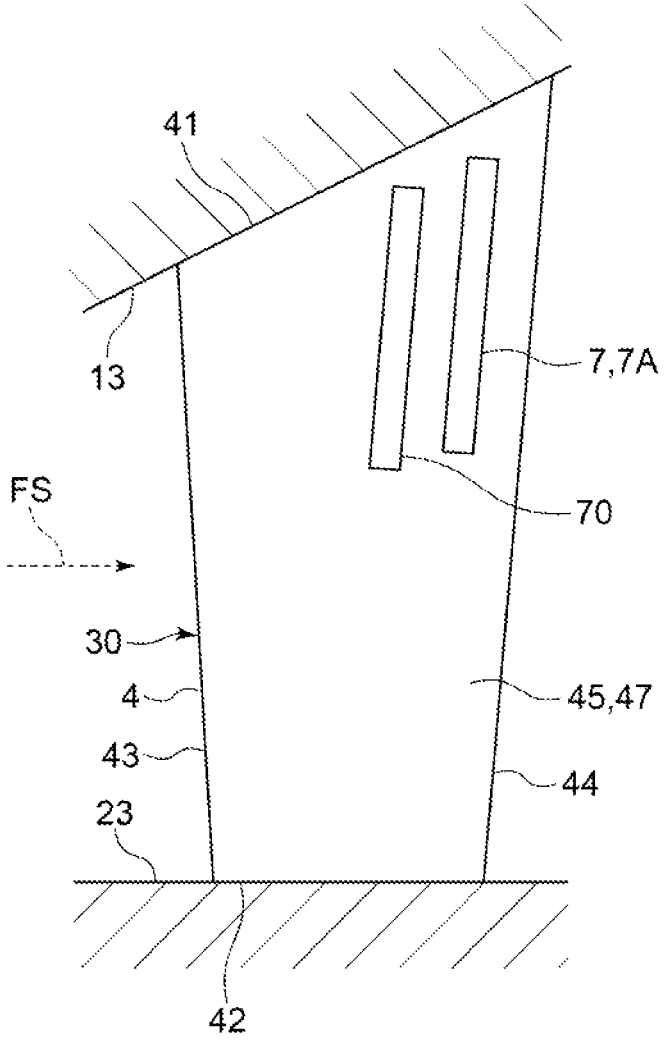
FIG. 4 is a schematic view of the steam turbine stator vane according to a comparative example, taken along the axial direction.
Figure 5:
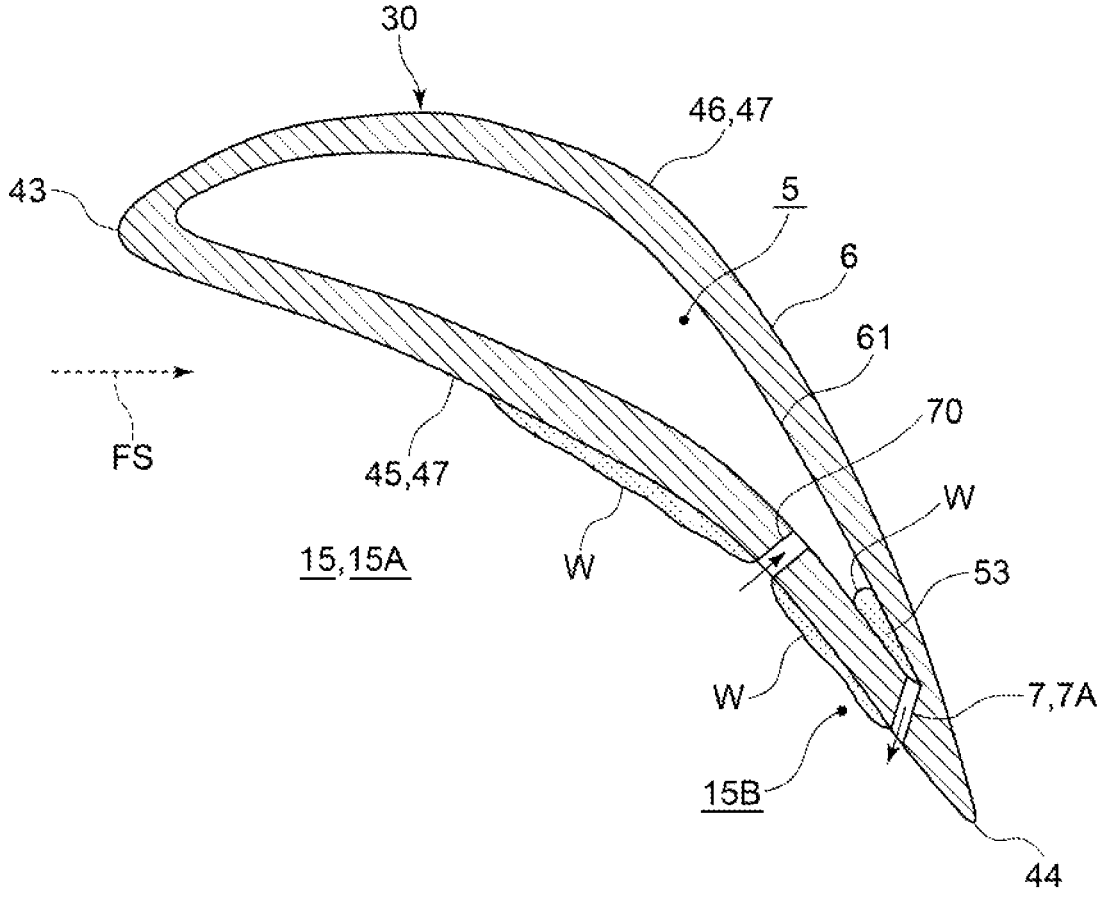
FIG. 5 is a schematic cross-sectional view of the steam turbine stator vane according to a comparative example, taken along the direction orthogonal to the height direction.

FIG. 4 is a schematic view of the steam turbine stator vane according to a comparative example, taken along the axial direction. FIG. 5 is a schematic cross-sectional view of the steam turbine stator vane according to a comparative example, taken along the direction orthogonal to the height direction.

As shown in FIG. 4, 5, the stator vane 30 according to the comparative example is different from the stator vane 3 as shown in FIG. 2, 3 in that instead of the groove portion 8, a second slit 70 is disposed in the pressure surface 45 (vane surface 47). As shown in FIG. 5, as with the slit 7, the second slit 70 communicates with the moisture removal channel 5. The slit 7 is disposed between the second slit 70 and the trailing edge 44, and is lower in pressure than the second slit 70. In this case, the liquid W adhering to the vane surface 47 is sucked to the moisture removal channel 5 by the second slit 70, and the liquid W sucked to the moisture removal channel 5 may spout (flow back) from the slit 7 due to a differential pressure between the slit 7 and the second slit 70.

Figure 6:
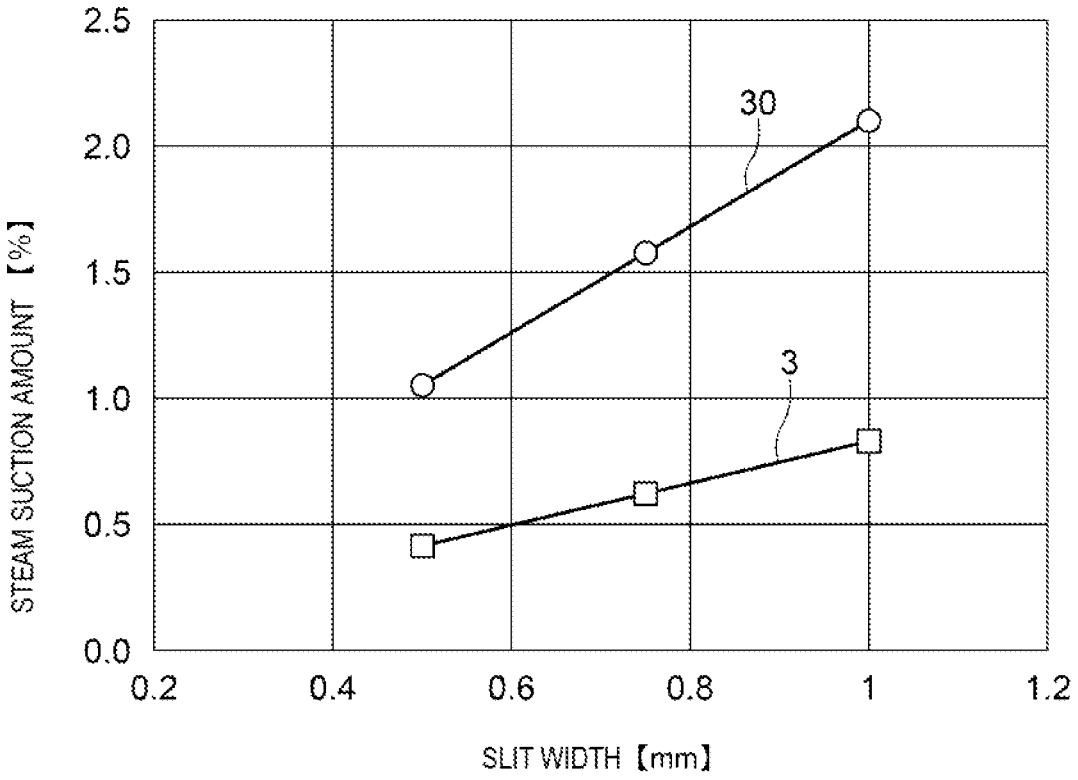
FIG. 6 is a graph for describing a relationship between a slit width and a steam suction amount of each of the steam turbine stator vane according to an embodiment of the present invention and the steam turbine stator vane according to the comparative example.

FIG. 6 is a graph for describing a relationship between a slit width and a steam suction amount of each of the steam turbine stator vane according to an embodiment of the present invention and the steam turbine stator vane according to the comparative example. In FIG. 6, the abscissa indicates the slit width of the slit 7 or the second slit 70, and the ordinate indicates the suction amount of the steam sucked from the outside of the stator vane 3 to the moisture removal channel 5 via the slit 7 or the second slit 70. As shown in FIG. 6, if the slit width is increased, the suction amount of the steam sucked to the moisture removal channel 5 is increased. Further, the stator vane 3 where the one slit 7 communicates with the moisture removal channel 5 has a smaller steam suction amount corresponding to any slit width than a stator vane 30 where two slits (the slit 7 and the second slit 70) communicate with the moisture removal channel 5. That is, as compared with the stator vane 30, the stator vane 3 can reduce the suction amount of the steam sucked to the moisture removal channel 5. By reducing the suction amount of the steam sucked to the moisture removal channel 5, it is possible to prevent a decrease in amount of the drive steam for rotating the rotor blade 12, making it possible to prevent a decrease in performance of the steam turbine 1.

As described above, for example, as shown in FIG. 2, 3, the stator vane 3 according to some embodiments includes the above-described vane body portion 4, the above-described moisture removal channel 5, the above-described at least one slit 7, and the above-described at least one groove portion 8 at least a part of which overlaps the at least one slit 7 along the height direction.

In the illustrated embodiment, as shown in FIG. 2, the at least one slit 7 includes a single slit 7A extending along the height direction. The at least one groove portion 8 has a cross-sectional shape formed into a U-shape, and includes an opening end portion 81 opening to the base end portion 41.

With the above configuration, the stator vane 3 includes the slit 7 and the groove portion 8 disposed in the vane surface 47 which is the surface of the stator vane 3, and the slit 7 and the groove portion 8 overlap at least partially along the height direction. Thus, it is possible to remove the liquid W collected in the vane surface 47 by a section (upstream drainage section) of the slit 7 and the groove portion 8 disposed upstream (the side of the leading edge 43) of the vane surface 47. Further, it is possible to remove the liquid W collected downstream of the above-described upstream drainage section in the vane surface 47, by a section (downstream drainage section) of the slit 7 and the groove portion 8 disposed downstream (the side of the trailing edge 44) of the vane surface 47. That is, the stator vane 3 can remove the liquid W adhering to the vane surface 47, by the groove portion 8 and the slit 7 having higher removal efficiency of the liquid W than the groove portion 8. Thus, it is possible to improve the removal efficiency of the liquid W adhering to the vane surface 47.

Further, since one of the above-described upstream drainage section or the above-described downstream drainage section is the groove portion 8 that does not communicate with the moisture removal channel 5, the stator vane 3 can reduce the amount of the drive steam leaking to the moisture removal channel 5 through the slit, as compared with the configuration, where the two slits (the slit 7, the second slit 70) overlapping each other along the height direction are disposed in the vane surface 47, as in the stator vane 30 according to the comparative example. Further, unlike the configuration, where the two slits overlapping each other along the height direction are disposed in the vane surface 47, as in the stator vane 30 according to the comparative example, the stator vane 3 is free from the risk that the liquid W flows back from the moisture removal channel 5 via the slit 7, and thus the slit width need not be increased to improve a suction pressure of the slit 7. By suppressing the suction pressure of the slit 7, it is possible to further reduce the amount of the drive steam leaking to the moisture removal channel 5 through the slit 7. Thus, the stator vane 3 can reduce the amount of the drive steam leaking to the moisture removal channel 5 through the slit 7, making it possible to prevent the decrease in performance of the steam turbine 1.

In some embodiments, for example, as shown in FIG. 2, the above-described at least one groove portion 8 is configured to be inclined to the side of the trailing edge 44 from the tip end portion 42 toward the base end portion 41. In this case, since the at least one groove portion 8 is configured to be inclined to the side of the trailing edge 44 from the tip end portion 42 toward the base end portion 41, the liquid W stored in the groove portion 8 is pushed by the flow of the steam flowing through the region 15A (in the steam turbine 1) where the steam flow flows, and flows toward the side of the base end portion 41 which is a discharge side of the liquid W. Thus, the above-described groove portion 8 can improve removal efficiency of the liquid stored in the groove portion 8.

Figure 7:
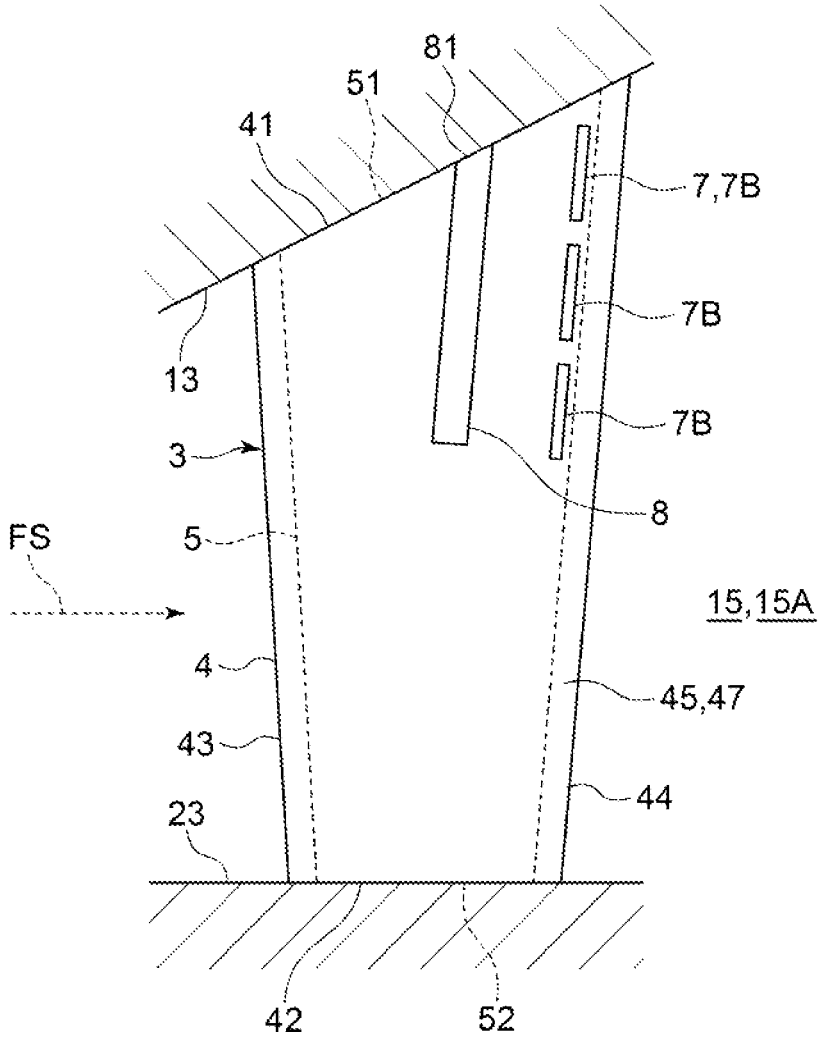
FIG. 7 is a schematic view of the steam turbine stator vane according to a first modified example, taken along the axial direction.
Figure 8:
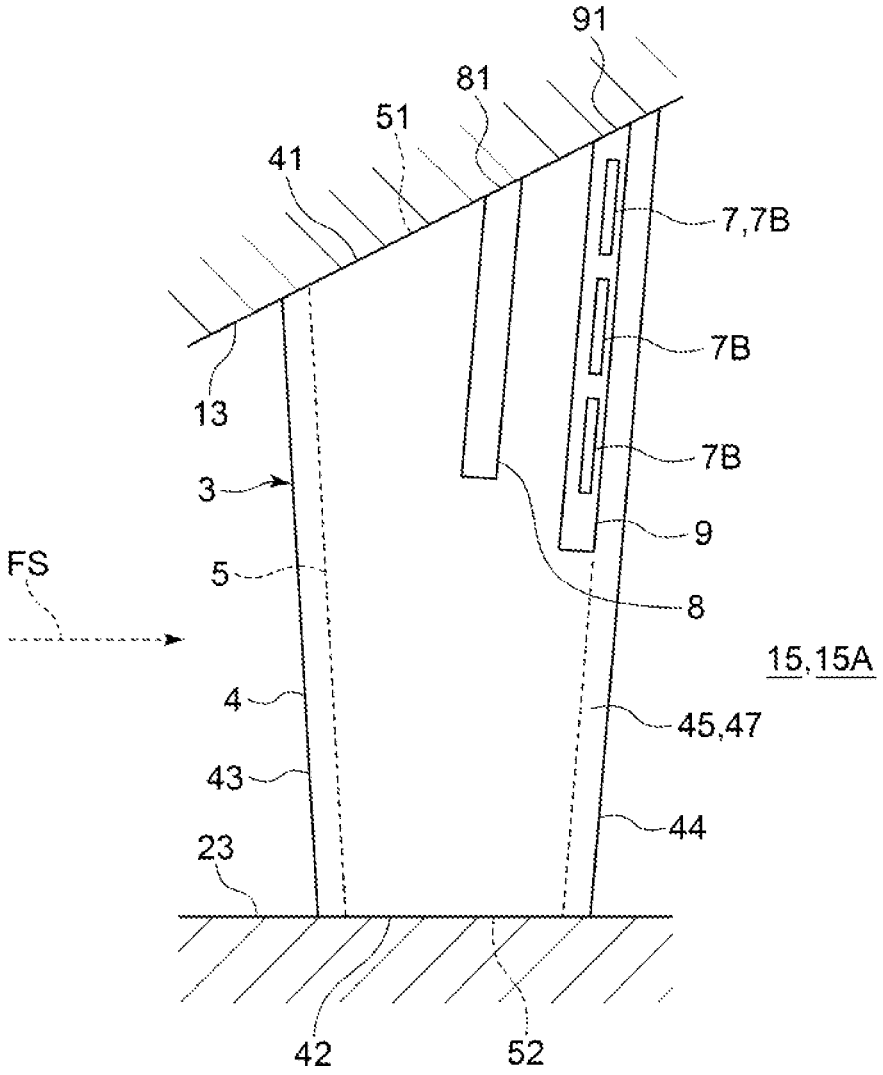
FIG. 8 is a schematic view of the steam turbine stator vane according to a second modified example, taken along the axial direction.
Figure 9:
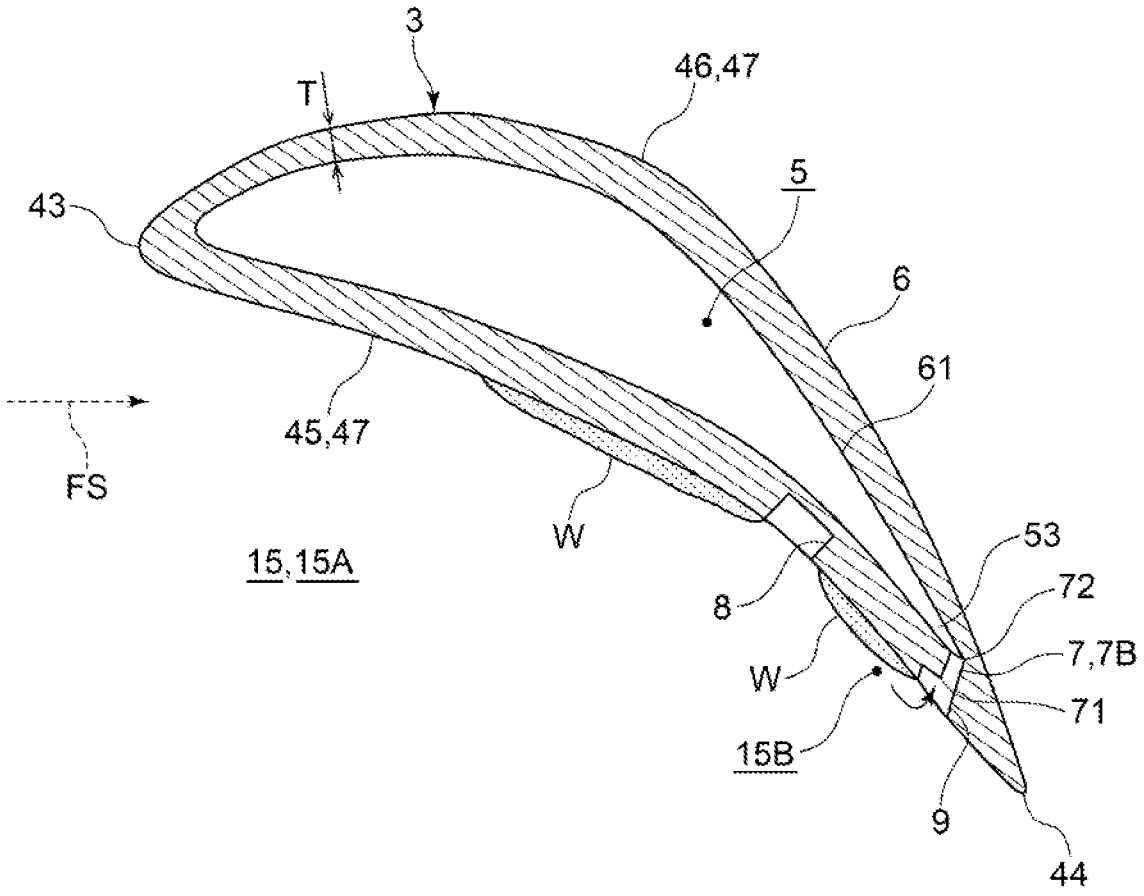
FIG. 9 is a schematic cross-sectional view of the steam turbine stator vane according to the second modified example, taken along the direction orthogonal to the height direction.

FIG. 7 is a schematic view of the steam turbine stator vane according to a first modified example, taken along the axial direction. FIG. 8 is a schematic view of the steam turbine stator vane according to a second modified example, taken along the axial direction. FIG. 9 is a schematic cross-sectional view of the steam turbine stator vane according to the second modified example, taken along the direction orthogonal to the height direction.

In some embodiments, for example, as shown in FIG. 7, 8, the at least one slit 7 includes a plurality of slits 7B disposed separately from each other in the height direction. In the illustrated embodiments, the plurality of slits 7B are arranged in series along the height direction and extend along the height direction.

With the above configuration, since the plurality of slits 7B are disposed separately from each other in the height direction, as compared with a case where the single slit 7A extends along the height direction, it is possible to improve strength of the stator vane 3 in the vicinity of the slit 7. Improving the strength of the stator vane 3 in the vicinity of the slit 7, it is possible to reduce the thickness of the stator vane 3, and thus to reduce a production cost of the stator vane 3.

In some embodiments, for example, as shown in FIG. 8, 9, the above-described stator vane 3 includes a recess 9 which is disposed in the vane surface 47 and to which the plurality of slits 7B open. In the illustrated embodiment, the recess 9 extends from the base end portion 41 of the vane body portion 4 along the height direction, and at least a part of the recess 9 overlaps the at least one groove portion 8 along the height direction. The recess 9 has a cross-sectional shape formed into a U-shape, and includes an opening end portion 91 opening to the base end portion 41. In each of the plurality of slits 7B, the inlet opening 71 opens to the bottom of the recess 9.

In the embodiment shown in FIG. 8, the recess 9 is disposed between the center and the base end portion 41 in the height direction. In some other embodiments, the recess 9 may extend between the center and the tip end portion 42 in the height direction, or may extend over the entire length in the height direction.

With the above configuration, since the plurality of slits 7B disposed separately from each other open to the recess 9 disposed in the vane surface 47, the liquid W adhering to the vane surface 47 is pushed by the flow of the steam flowing through the region 15A, enters the recess 9, and is stored in the recess 9. Thus, the stator vane 3 including the recess 9 can prevent the liquid W adhering to the vane surface 47 from flowing downstream of the slits 7B in the vane surface 47 through the slits 7B. Thus, the stator vane 3 including the recess 9 can improve removal efficiency of the liquid W adhering to the vane surface 47.

In some embodiments, as shown in FIG. 8, the above-described recess 9 is configured to be inclined to the side of the trailing edge 44 from the tip end portion 42 toward the base end portion 41. In this case, since the recess 9 is configured to be inclined to the side of the trailing edge 44 from the tip end portion 42 toward the base end portion 41, the liquid W stored in the recess 9 is pushed by the flow of the steam flowing through the region 15A (in the steam turbine 1) where the steam flow flows, and flows toward the side of the base end portion 41 which is the discharge side of the liquid W. The liquid W flowing toward the side of the base end portion 41 passes through the slit 7B located on the side of the base end portion 41 or is discharged from the opening end portion 91 opening to the base end portion 41 to be sent to the cavity 24. Thus, the above-described recess 9 can improve removal efficiency of the liquid W stored in the recess 9.

Figure 10:
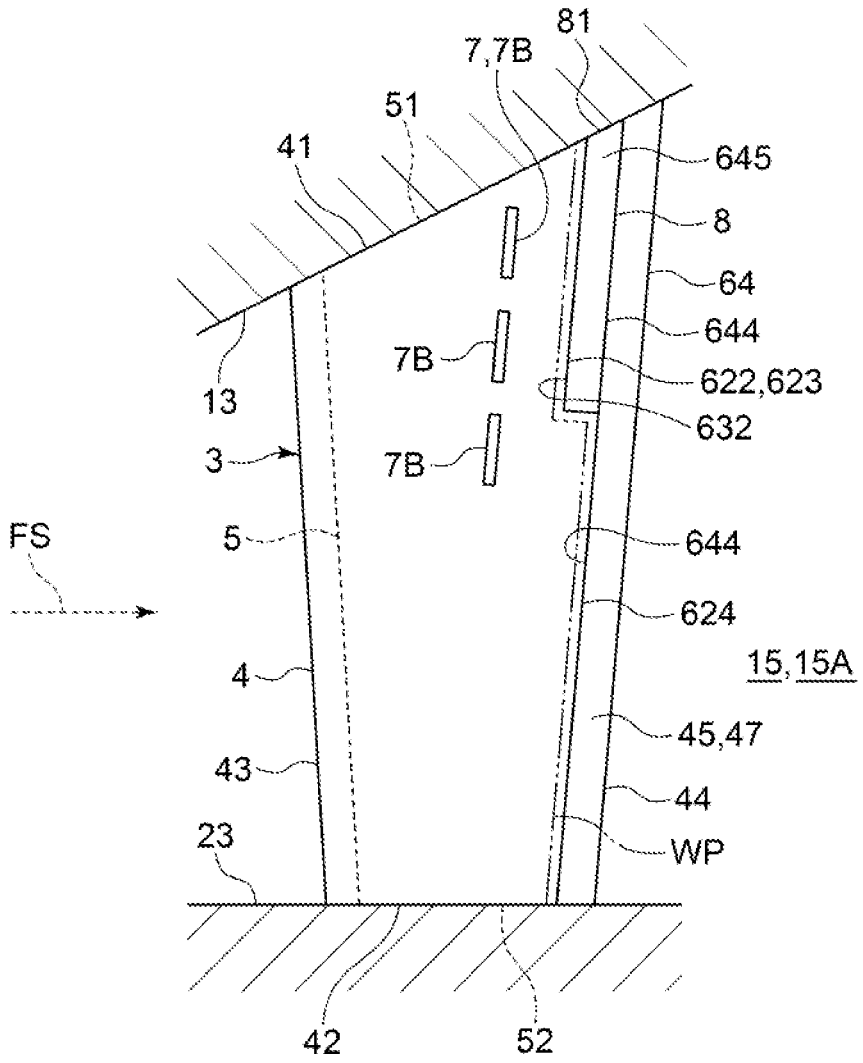
FIG. 10 is a schematic view of the steam turbine stator vane according to a third modified example, taken along the axial direction.
Figure 11:
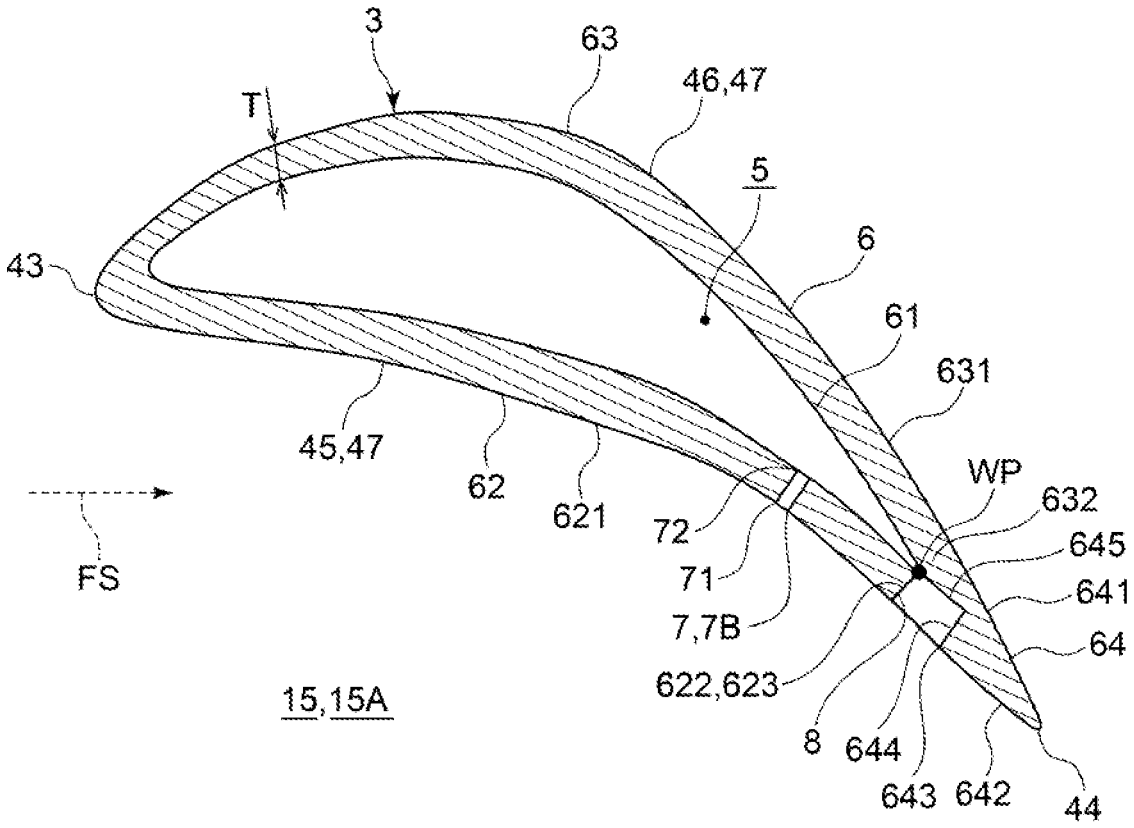
FIG. 11 is a schematic cross-sectional view of the steam turbine stator vane according to the third modified example, taken along the direction orthogonal to the height direction.
Figure 12:
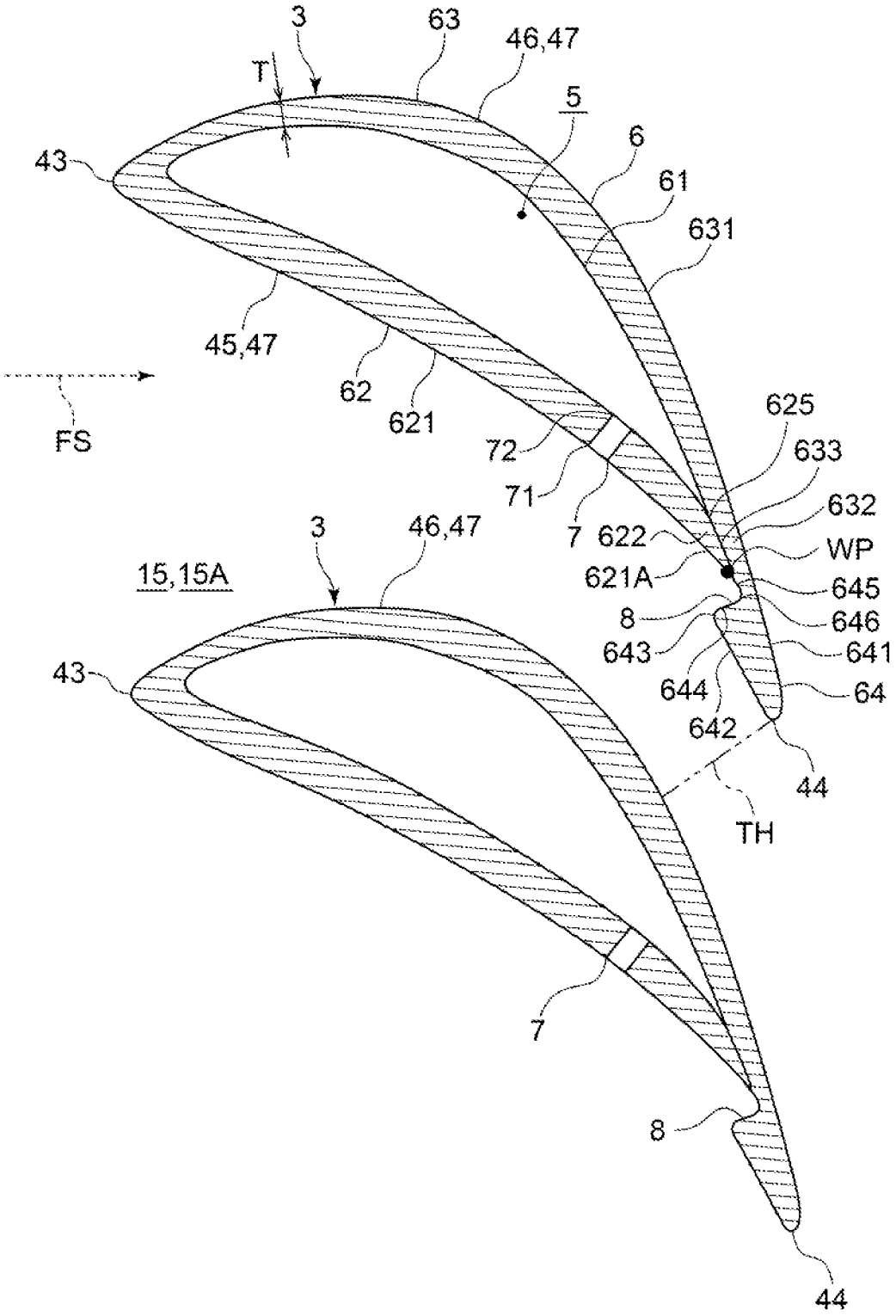
FIG. 12 is a schematic cross-sectional view of the steam turbine stator vane according to a fourth modified example, taken along the direction orthogonal to the height direction.
Figure 13:
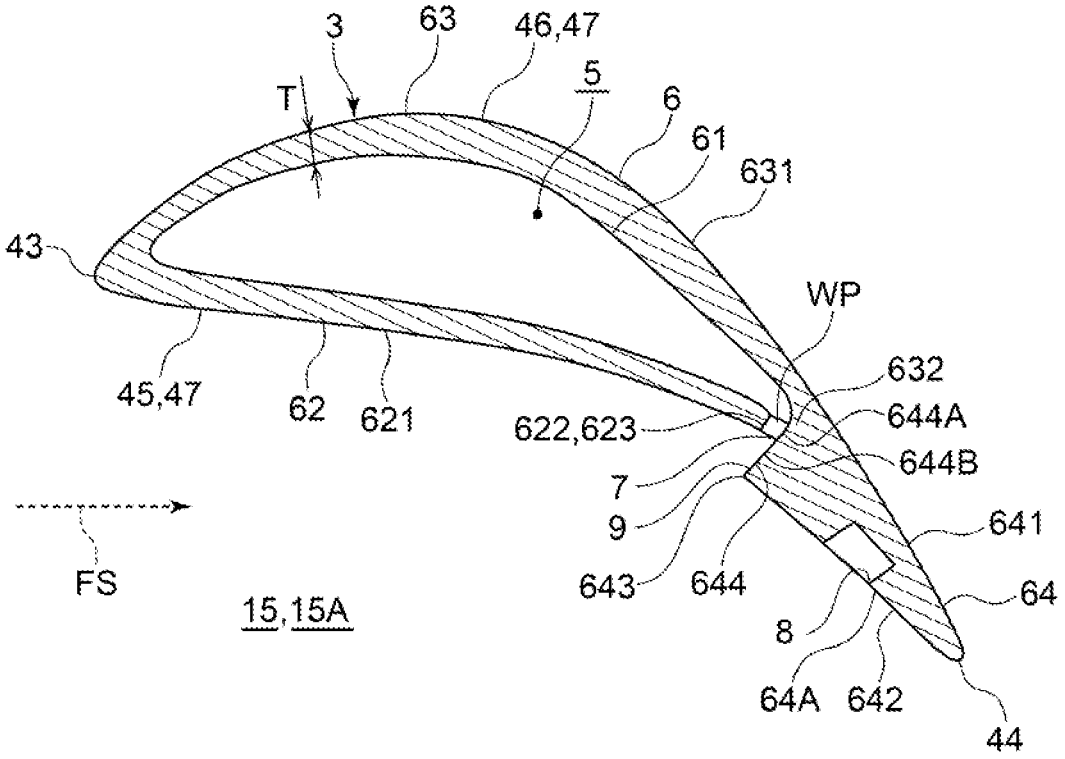
FIG. 13 is a schematic cross-sectional view of the steam turbine stator vane according to a fifth modified example, taken along the direction orthogonal to the height direction.
Figure 14:
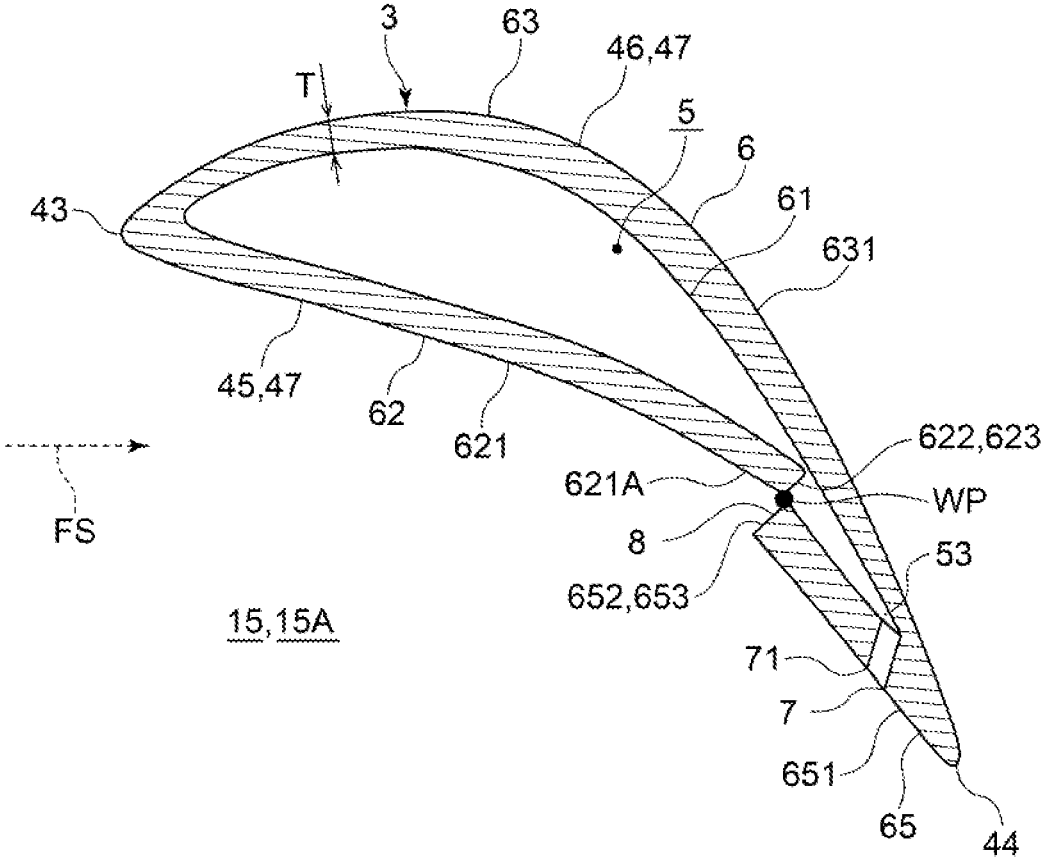
FIG. 14 is a schematic cross-sectional view of the steam turbine stator vane according to a sixth modified example, taken along the direction orthogonal to the height direction.

FIG. 10 is a schematic view of the steam turbine stator vane according to a third modified example, taken along the axial direction. FIG. 11 is a schematic cross-sectional view of the steam turbine stator vane according to the third modified example, taken along the direction orthogonal to the height direction. FIG. 12 is a schematic cross-sectional view of the steam turbine stator vane according to the fourth modified example, taken along the direction orthogonal to the height direction. FIG. 13 is a schematic cross-sectional view of the steam turbine stator vane according to the fifth modified example, taken along the direction orthogonal to the height direction. FIG. 14 is a schematic cross-sectional view of the steam turbine stator vane according to the sixth modified example, taken along the direction orthogonal to the height direction.

In some embodiments, as shown in FIGS. 10 to 13, the above-described slit 7 is disposed between the above-described groove portion 8 and the leading edge 43. In this case, it is possible to remove the liquid W that cannot be removed from the vane surface 47 by the slit 7 or the liquid W adhering between the slit 7 and the trailing edge 44 on the vane surface 47, by the groove portion 8 disposed between the slit 7 and the trailing edge 44 on the vane surface 47.

In some embodiments, as shown in FIGS. 2, 3, 7 to 9, and 14, the above-described slit 7 is disposed between the above-described groove portion 8 and the trailing edge 44. In this case, it is possible to remove the liquid W that cannot be removed from the vane surface 47 by the groove portion 8 or the liquid W adhering between the groove portion 8 and the trailing edge 44 on the vane surface 47, by the slit 7 disposed between the groove portion 8 and the trailing edge 44 on the vane surface 47. The groove portion 8 can reduce the amount of the liquid W reaching the slit 7, and the slit 7 has higher removal efficiency of the liquid W adhering to the vane surface 47 than the groove portion 8, making it possible to remove the liquid W reaching the slit 7. Thus, with the above configuration, by disposing the slit 7 between the groove portion 8 and the trailing edge 44, it is possible to effectively remove the liquid W adhering to the vane surface 47.

In some embodiments, as shown in FIGS. 3, 9, and 11 to 14, the above-described vane body portion 4 includes the above-described curved plate 6 encompassing the moisture removal channel 5 and configured such that a difference between a maximum value and a minimum value of a thickness T of the curved plate 6 falls within 40% of an average value of the thickness T. In this case, by equalizing the thickness T of the curved plate 6, it is possible to reduce a material cost of the curved plate 6 by cutting wasteful consumption of a material forming the curved plate 6, and thus to reduce the production cost of the stator vane 3.

In some embodiments, the vane body portion 4 including the curved plate 6 described above is a sheet-metal part where the shape of the vane body portion 4 is formed by performing sheet-metal processing on at least one sheet metal. In this case, it is possible to form the vane body portion 4 including the curved plate 6 by performing sheet-metal processing (such as cutting, bending, and welding) on one or a plurality of sheet metals (such as metal plate materials each formed into a thin flat shape by rolling or the like). Thus, it is possible to reduce the material cost and a processing cost of the vane body portion 4. Thus, with the above configuration, since it is possible to reduce the material cost and the processing cost of the vane body portion 4, it is possible to reduce the production cost of the stator vane 3.

In some embodiments, as shown in FIGS. 10 to 14, the above-described curved plate 6 includes a pressure surface-side curved plate 62 which has a surface 621 including at least a part of the above-described pressure surface 45, and a suction surface-side curved plate 63 which has a surface 631 including at least a part of the above-described suction surface 46. One of the above-described at least one slit 7 or the above-described at least one groove portion 8 is configured to include a joint WP where one end portion 622 of the pressure surface-side curved plate 62 and one end portion 632 of the suction surface-side curved plate 63 are joined by welding.

In the illustrated embodiment, as shown in FIGS. 10 to 14, the pressure surface-side curved plate 62 and the suction surface-side curved plate 63 each have a shape which is formed by folding one sheet metal into a V-shape such that the leading edge 43 is formed. Subsequently, joining the one end portion 622 (rear end portion) of the pressure surface-side curved plate 62 and the one end portion 632 (rear end portion) of the suction surface-side curved plate 63 by welding, the above-described curved plate 6 and one of the slit 7 or the groove portion 8 are formed. In some other embodiments, the shape of the curved plate 6 may be formed by joining the plurality of sheet metals by welding.

With the above configuration, one of the slit 7 or the groove portion 8 includes the joint WP where the one end portion 622 of the pressure surface-side curved plate 62 and the one end portion 632 of the suction surface-side curved plate 63 are joined by welding. That is, the shape of one of the slit 7 or the groove portion 8 is formed, when the curved plate 6 is formed by welding the one end portion 622 of the pressure surface-side curved plate 62 and the one end portion 632 of the suction surface-side curved plate 63. With the above configuration, since additional processing such as cutting is not needed to form one of the slit 7 or the groove portion 8, it is possible to reduce the processing cost, and thus to reduce the production cost of the stator vane 3. Further, with the above configuration, since one of the slit 7 or the groove portion 8 can be formed without processing such as cutting, it is possible to prevent a decrease in strength in the vicinity of one of the slit 7 or the groove portion 8.

In some embodiments, as shown in FIGS. 10 to 12, the above-described vane body portion 4 includes the above-described curved plate 6 including the pressure surface-side curved plate 62 and the suction surface-side curved plate 63, and a trailing edge portion 64 disposed between the above-described joint WP and the trailing edge 44. The trailing edge portion 64 has a trailing edge-side pressure surface 642 connected to the trailing edge 44, and a trailing edge-side wall surface 644 extending from a front end portion 643 on the trailing edge-side pressure surface 642 along a direction intersecting with the trailing edge-side pressure surface 642. The above-described at least one groove portion 8 includes the above-described joint WP, and a part of the groove portion 8 is defined by the trailing edge-side wall surface 644.

In the embodiment shown in FIG. 10, 11, the trailing edge portion 64 is disposed integrally with the one end portion 632 of the suction surface-side curved plate 63, and the trailing edge-side suction surface 641 of the trailing edge portion 64 is loosely connected to the surface 631 of the suction surface-side curved plate 63. The trailing edge portion 64 is formed by the sheet metal forming the suction surface-side curved plate 63, and the shape of the trailing edge portion 64 is formed by sheet-metal processing. The groove portion 8 has a U-shaped cross-sectional shape which is defined by an end surface 623 at the one end portion 622 of the pressure surface-side curved plate 62, the trailing edge-side wall surface 644, and a bottom surface 645 connecting end portions of the end surface 623 and the trailing edge-side wall surface 644 on the side of the suction surface 46. The above-described joint WP joins a section between the end surface 623 and the bottom surface 645. The slit 7 (such as 7B) is disposed in the pressure surface-side curved plate 62 located between the groove portion 8 and the leading edge 43.

In the embodiment shown in FIG. 10, 11, in a section of the vane body portion 4 where the groove portion 8 does not extend in the height direction, a protruding end surface 624 protruding between the above-described end surface 623 and the trailing edge 44, and a trailing edge-side wall surface 644 are joined by welding.

In the embodiment shown in FIG. 12, the trailing edge portion 64 is disposed integrally with the one end portion 632 of the suction surface-side curved plate 63, and the trailing edge-side suction surface 641 of the trailing edge portion 64 is loosely connected to the surface 631 of the suction surface-side curved plate 63. The trailing edge portion 64 is formed by the sheet metal forming the suction surface-side curved plate 63, and the shape of the trailing edge portion 64 is formed by sheet-metal processing. In the one end portion 622 of the pressure surface-side curved plate 62, an inclined surface 625, with an edge portion on the side of the pressure surface 45 being inclined between the trailing edge 44 and an edge portion on the side of the suction surface 46, is formed. The above-described inclined surface 625 is joined by welding in contact with the inner surface 633 at the one end portion 632 of the suction surface-side curved plate 63. The groove portion 8 is defined by the trailing edge-side wall surface 644, the bottom surface 645 extending from the suction surface-side end portion 646 of the trailing edge-side wall surface 644 along the direction intersecting with the trailing edge-side wall surface 644, and a surface 621A of the surface 621 of the pressure surface-side curved plate 62 in the vicinity of the one end portion 622. The above-described surface 621A is loosely connected to the bottom surface 645. The above-described joint WP joins a section between the surface 621A and the bottom surface 645. The slit 7 is disposed in the pressure surface-side curved plate 62 located between the groove portion 8 and the leading edge 43.

In the embodiment shown in FIG. 12, the trailing edge-side pressure surface 642 is disposed to protrude between the surface 621 of the pressure surface-side curved plate 62 and the suction surface 46 of the stator vane 3 adjacent in the circumferential direction, and a gap between the trailing edge-side pressure surface 642 and the above-described suction surface 46 is narrow. A section between the trailing edge 44 of the stator vane 3 and the suction surface 46 of the stator vane 3 adjacent in the circumferential direction is a throat section TH. In the above-described throat section TH, it is configured such that the gap between the stator vanes 3 is minimum. The flow velocity of steam is low upstream of the throat section TH, and thus a pressure loss is small. Thus, the above-described trailing edge-side pressure surface 642 does not impair the steam flow.

With the above configuration, the at least one groove portion 8 includes the joint WP, and a part of the groove portion 8 is defined by the trailing edge-side wall surface 644. That is, the shape of the groove portion 8 is formed as a part of the trailing edge-side wall surface 644 of the trailing edge portion 64, when the curved plate 6 is formed by welding. Since a part of the above-described groove portion 8 is defined by the trailing edge-side wall surface 644 extending along the direction intersecting with the trailing edge-side pressure surface 642, it is possible to effectively prevent the liquid W adhering to the vane surface 47 from flowing toward the trailing edge-side pressure surface 642 from the trailing edge-side wall surface 644.

In some embodiments, as shown in FIG. 13, the above-described vane body portion 4 includes the above-described curved plate 6 including the pressure surface-side curved plate 62 and the suction surface-side curved plate 63, and the trailing edge portion 64 disposed between the above-described joint WP and the trailing edge 44. The trailing edge portion 64 has the trailing edge-side pressure surface 642 connected to the trailing edge 44, and the trailing edge-side wall surface 644 extending from the front end portion 643 on the trailing edge-side pressure surface 642 along the direction intersecting with the trailing edge-side pressure surface 642. The above-described at least one slit 7 includes the above-described joint WP and a part of the slit 7 is defined by the trailing edge-side wall surface 644.

In the embodiment shown in FIG. 13, the trailing edge portion 64 is disposed integrally with the one end portion 632 of the suction surface-side curved plate 63. The trailing edge-side suction surface 641 of the trailing edge portion 64 is loosely connected to the surface 631 of the suction surface-side curved plate 63. Further, the trailing edge-side wall surface 644 is connected to the inner surface 61. The trailing edge portion 64 is formed by the sheet metal forming the suction surface-side curved plate 63, and the shape of the trailing edge portion 64 is formed by sheet-metal processing. The above-described one end portion 632 may include the trailing edge portion 64. The trailing edge portion 64 includes a thick portion 64A configured such that a thickness gradually increases toward the side of the leading edge 43.

The shape of the slit 7 is defined by the end surface 623 at the one end portion 622 of the pressure surface-side curved plate 62, the trailing edge-side wall surface 644, and the joint WP joining a section between the end surface 623 and the trailing edge-side wall surface 644. The groove portion 8 is disposed in the trailing edge-side pressure surface 642 of the thick portion 64A (trailing edge portion 64) located between the slit 7 and the trailing edge 44, and has a U-shaped cross-sectional shape. By thus disposing the groove portion 8 in the trailing edge portion 64 located between the slit 7 and the trailing edge 44, as compared with a case where the groove portion 8 is disposed in the pressure surface-side curved plate 62 located between the slit 7 and the leading edge 43, it is possible to improve removal efficiency of the liquid adhering to the vane surface 47. Further, the process of forming the groove portion 8 in the trailing edge portion 64 can be performed more easily than the process of forming the groove portion 8 in the pressure surface-side curved plate 62. Furthermore, with the configuration where the groove portion 8 is not disposed in the pressure surface-side curved plate 62, it is possible to reduce the thickness of the pressure surface-side curved plate 62 (curved plate 6).

Moreover, setting the joint WP on the trailing edge-side wall surface 644 to a section 644A spaced apart from the front end portion 643 toward the side of the suction surface 46, it is possible to form the above-described recess 9 by a section 644B of the trailing edge-side wall surface 644 between the above-described section 644A and the front end portion 643, and the surface 621 of the pressure surface-side curved plate 62. That is, the shape of the recess 9 is formed as a part of the trailing edge-side wall surface 644 of the trailing edge portion 64, when the curved plate 6 is formed by welding.

With the above configuration, the at least one slit 7 includes the joint WP, and a part of the slit 7 is defined by the trailing edge-side wall surface 644. That is, the shape of the slit 7 is formed as a part of the trailing edge-side wall surface 644 of the trailing edge portion 64, when the curved plate 6 is formed by welding. Since a part of the above-described slit 7 is defined by the trailing edge-side wall surface 644 extending along the direction intersecting with the trailing edge-side pressure surface 642, the liquid W adhering to the vane surface 47 is removed from the vane surface 47 by the slit 7 in the trailing edge-side wall surface 644. Thus, with the above configuration, it is possible to effectively prevent the liquid W adhering to the vane surface 47 from flowing toward the trailing edge-side pressure surface 642 from the trailing edge-side wall surface 644.

In some embodiments, as shown in FIG. 14, the above-described vane body portion 4 includes the above-described curved plate 6 including the pressure surface-side curved plate 62 and the suction surface-side curved plate 63. The above-described suction surface-side curved plate 63 includes an extension portion 65 which extends from the trailing edge 44 toward the leading edge 43 and has a surface 651 including at least a part of the pressure surface 45. The one end portion 632 of the suction surface-side curved plate 63 includes a front end portion 652 of the extension portion 65 located on the side of the leading edge 43. The above-described at least one groove portion 8 includes the above-described joint WP, and a part of the groove portion 8 is defined by an end surface 653 at the front end portion 652 of the extension portion 65.

In the embodiment shown in FIG. 14, the suction surface-side curved plate 63 and the extension portion 65 each have a shape which is formed by folding one sheet metal into a V-shape such that the trailing edge 44 is formed. The end surface 653 at the front end portion 652 extends along the direction intersecting with the surface 651 and the surface 621 of the pressure surface-side curved plate 62, and is a stepped surface connecting the surface 621 and the surface 651. The groove portion 8 is defined by the end surface 653 and the surface 621A of the surface 621 of the pressure surface-side curved plate 62 in the vicinity of the one end portion 622. The above-described joint WP joins a section between the end surface 653 and the surface 621A. The slit 7 is disposed in the extension portion 65 located between the groove portion 8 and the trailing edge 44, and the inlet opening 71 opens to the surface 651.

With the above configuration, the at least one groove portion 8 includes the joint WP and a part of the groove portion 8 is defined by the end surface 653 at the front end portion 652 of the extension portion 65. That is, the shape of the groove portion 8 is formed as a part of the end surface 653 at the front end portion 652 of the extension portion 65, when the curved plate 6 is formed by welding the one end portion 622 of the pressure surface-side curved plate 62 and the front end portion 652. Since a part of the above-described groove portion 8 is defined by the end surface 653 at the front end portion 652 of the extension portion 65 located on the side of the leading edge 43, it is possible to effectively prevent the liquid W adhering to the end surface 653 from flowing toward the surface 651 (pressure surface) of the extension portion 65.

As shown in FIG. 2, the steam turbine 1 according to some embodiments includes the above-described stator vane 3, the above-described annular member 13 for supporting the stator vane 3, and the above-described cavity 24 disposed in the annular member 13 and configured to receive the liquid W from each of the moisture removal channel 5 and the at least one groove portion 8 in the vane body portion 4.

With the above configuration, since the steam turbine 1 includes the cavity 24 disposed in the annular member 13 and configured to receive the liquid from each of the moisture removal channel 5 and the at least one groove portion 8 in the vane body portion 4, it is possible to store, in the cavity 24, the liquid W removed from the vane surface 47 by the slit 7 and the groove portion 8. Storing, in the cavity 24, the liquid W removed from the vane surface 47 by the slit 7 and the groove portion 8, it is possible to prevent that the liquid W accumulates in the slit 7 and the moisture removal channel 5 in the vane body portion 4, and removal efficiency of the liquid W adhering to the vane surface 47 by the slit 7 and the groove portion 8 is decreased. Thus, the above-described steam turbine 1 can effectively remove the liquid W adhering to the vane surface 47 by the slit 7 and the groove portion 8.

Figure 15:
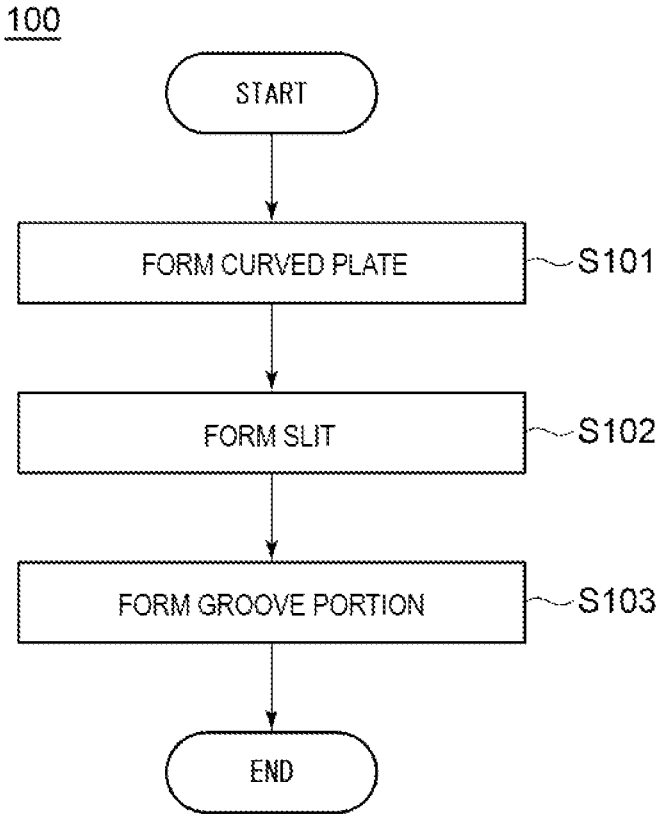
FIG. 15 is a flowchart showing an example of a production method for the steam turbine stator vane according to an embodiment of the present invention.

FIG. 15 is a flowchart showing an example of a production method for the steam turbine stator vane according to an embodiment of the present invention.

As shown in FIG. 15, a production method 100 for the steam turbine stator vane according to some embodiments includes a slit forming step S102 of forming the above-described at least one slit 7, and a groove portion forming step S103 of forming the above-described at least one groove portion 8. In the illustrated embodiment, as shown in FIG. 15, the production method 100 for the steam turbine stator vane further includes a curved plate forming step S101 of forming the above-described curved plate 6. The curved plate forming step S101 includes forming the above-described curved plate 6 from one or a plurality of sheet metals by sheet-metal processing.

The slit forming step S102 includes forming the at least one slit 7 (7A, 7B) that opens to the vane surface 47 of the vane body portion 4, which has the vane surface 47 including the pressure surface 45 and the suction surface 46, to communicate with the moisture removal channel 5 disposed in the vane body portion 4, and extends along the height direction from the base end portion 41 toward the tip end portion 42 of the vane body portion 4.

The groove portion forming step S103 includes forming the at least one groove portion 8 which extends from the base end portion 41 along the height direction in the vane surface 47 and at least a part of which overlaps the at least one slit 7 along the height direction.

Each of the slit 7 and the groove portion 8 may be formed by cutting, or the shape of each of the slit 7 and the groove portion 8 may be formed when the curved plate 6 is formed as described above.

With the above method, the production method 100 for the steam turbine stator vane includes the slit forming step S102 of forming the at least one slit 7, and the groove portion forming step S103 of forming the at least one groove portion 8. The stator vane 3 produced by the production method 100 for the steam turbine stator vane includes the slit 7 and the groove portion 8 disposed in the vane surface 47 which is the surface of the stator vane 3, and the slit 7 and the groove portion 8 overlap at least partially along the height direction. Thus, the stator vane 3 produced by the production method 100 for the steam turbine stator vane can improve removal efficiency of the liquid W adhering to the vane surface 47 and can prevent the decrease in performance of the steam turbine 1.

The present invention is not limited to the above-described embodiments, and also includes an embodiment obtained by modifying the above-described embodiments and an embodiment obtained by combining these embodiments as appropriate.

REFERENCE SIGNS LIST

1 Steam turbine
3 Stator vane
30 Stator vane according to comparative example
4 Vane body portion
41 Base end portion
42 Tip end portion
43 Leading edge
44 Trailing edge
45 Pressure surface
46 Suction surface
47 Vane surface
5 Moisture removal channel
51 Base end-side opening portion
52 Tip end-side opening portion
53 Trailing edge-side end portion
6 Curved plate
61 Inner surface
62 Pressure surface-side curved plate
63 Suction surface-side curved plate
64 Trailing edge portion
64A Thick portion
65 Extension portion
7, 7A, 7B Slit
70 Second slit
71 Inlet opening
72 Outlet opening
8 Groove portion
81 Opening end portion
9 Recess
91 Opening end portion
11 Rotor
12 Rotor blade
12A Last-stage rotor blade
13 Annular member
131 First communication hole
132 Second communication hole
133 Third communication hole
14 Bearing
15 Inner space
15A Region
15B Section

16 Casing
17 Exhaust hood
18 Steam inlet
19 Steam outlet
20 Steam introduction line
21 Steam generation device
22 Exhaust hood inlet
23 Diaphragm
24 Cavity
100 Production method for stator vane
LA Axis
S101 Curved plate forming step
S102 Slit forming step
S103 Groove portion forming step
T Thickness
TH Throat section
W Liquid
WP Joint

The invention claimed is:

1. A steam turbine stator vane, comprising:

a vane body portion which has a vane surface including a pressure surface and a suction surface;

a moisture removal channel disposed in the vane body portion;

at least one slit opening between a center of the pressure surface and a trailing edge in a direction orthogonal to a height direction from a base end portion toward a tip end portion which is connected to an annular member for supporting the steam turbine stator vane of the vane body portion to communicate with the moisture removal channel, and extending along the height direction; and at least one groove portion disposed between the center of the pressure surface and the trailing edge in the direction orthogonal to the height direction and extending from the base end portion along the height direction, at least a part of the at least one groove portion overlapping the at least one slit along the height direction.

2. The steam turbine stator vane according to claim 1, wherein the at least one groove portion is configured to be inclined to a side of the trailing edge from the tip end portion toward the base end portion.

3. The steam turbine stator vane according to claim 1, wherein the at least one slit includes a plurality of slits disposed separately from each other in the height direction.

4. The steam turbine stator vane according to claim 3, wherein the steam turbine stator vane further includes a recess which is disposed in the vane surface and to which the plurality of slits open.

5. The steam turbine stator vane according to claim 1, wherein the at least one slit is disposed between the at least one groove portion and a leading edge.

6. The steam turbine stator vane according to claim 1, wherein the at least one slit is disposed between the at least one groove portion and the trailing edge.

7. The steam turbine stator vane according to claim 1, wherein the vane body portion includes a curved plate encompassing the moisture removal channel and configured such that a difference between a maximum value and a minimum value of a thickness of the curved plate falls within 40% of an average value of the thickness.

8. The steam turbine stator vane according to claim 7, wherein the curved plate includes a pressure surface-side curved plate which has a surface including at least a part of the pressure surface, and a suction surface-side curved plate which has a surface including at least a part of the suction surface, and wherein one of the at least one slit or the at least one groove portion is configured to include a joint where one end portion of the pressure surface-side curved plate and one end portion of the suction surface-side curved plate are joined by welding.

9. The steam turbine stator vane according to claim 8, wherein the vane body portion further includes a trailing edge portion disposed between the joint and the trailing edge, the trailing edge portion having a trailing edge-side pressure surface connected to the trailing edge and a trailing edge-side wall surface extending from a front end portion on the trailing edge-side pressure surface along a direction intersecting with the trailing edge-side pressure surface, and wherein the at least one groove portion includes the joint, and a part of the at least one groove portion is defined by the trailing edge-side wall surface.

10. The steam turbine stator vane according to claim 8, wherein the vane body portion further includes a trailing edge portion disposed between the joint and the trailing edge, the trailing edge portion having a trailing edge-side pressure surface connected to the trailing edge and a trailing edge-side wall surface extending from a front end portion on the trailing edge-side pressure surface along a direction intersecting with the trailing edge-side pressure surface, and wherein the at least one slit includes the joint, and a part of the at least one slit is defined by the trailing edge-side wall surface.

11. The steam turbine stator vane according to claim 8, wherein the suction surface-side curved plate includes an extension portion extending from the trailing edge toward a leading edge, the extension portion having a surface including at least a part of the pressure surface, wherein the one end portion of the suction surface-side curved plate includes a front end portion of the extension portion located on a side of the leading edge, and wherein the at least one groove portion includes the joint, and a part of the at least one groove portion is defined by an end surface at the front end portion of the extension portion.

12. A steam turbine, comprising:

the steam turbine stator vane according to claim 1;

the annular member for supporting the steam turbine stator vane; and a cavity disposed in the annular member and configured to receive a liquid from each of the moisture removal channel and the at least one groove portion in the vane body portion.

13. A production method for a steam turbine stator vane, the method comprising:

a slit forming step of forming at least one slit that opens between a center of the pressure surface and a trailing edge in a direction orthogonal to a height direction from a base end portion which is connected to an annular member for supporting the steam turbine stator vane toward a tip end portion of the vane body portion, which has the vane surface including a pressure surface and a suction surface, to communicate with a moisture removal channel disposed in the vane body portion, and extends along the height direction; and a groove portion forming step of forming at least one groove portion extending from the base end portion along the height direction between the center of the pressure surface and the trailing edge in the direction orthogonal to the height direction, at least a part of the at least one groove portion overlapping the at least one slit along the height direction.

* * * * *